US007736501B2

(12) United States Patent
Garner et al.

(10) Patent No.: US 7,736,501 B2
(45) **Date of Patent: *Jun. 15, 2010**

(54) SYSTEM AND PROCESS FOR CONCENTRATING HYDROCARBONS IN A BITUMEN FEED

(75) Inventors: William Nicholas Garner, Fort McMurray (CA); Kim Jonathan Wiwchar, Fort McMurray (CA); Ian Mackay Noble, Fort McMurray (CA); Iain William Elder, Fort McMurray (CA); Michael Fong-Yin Lam, Fort Murray (CA)

(73) Assignee: Suncor Energy Inc., Calgary, Alberta (CA)

( * ) Notice: Subject to any disclaimer, the term of this patent is extended or adjusted under 35 U.S.C. 154(b) by 270 days.

This patent is subject to a terminal disclaimer.

(21) Appl. No.: 11/759,151

(22) Filed: Jun. 6, 2007

(65) Prior Publication Data

US 2008/0000810 A1 Jan. 3, 2008

Related U.S. Application Data

(63) Continuation-in-part of application No. 11/486,302, filed on Jul. 13, 2006, now Pat. No. 7,438,807, which is a continuation of application No. 10/306,003, filed on Nov. 29, 2002, now Pat. No. 7,141,162.

(51) Int. Cl.
*C10G 1/00* (2006.01)
*B03B 9/02* (2006.01)

(52) U.S. Cl. ..... 210/202; 210/512.1; 210/521; 209/12.1; 209/727; 209/729; 208/390; 208/391; 208/425; 208/426; 208/428

(58) Field of Classification Search ..... 210/202, 210/512.1, 521; 209/12.1, 727, 729; 208/390, 208/391, 425, 426, 428
See application file for complete search history.

(56) References Cited

U.S. PATENT DOCUMENTS 2,724,503 A 11/1955 Fontein ..... 209/729

(Continued)

FOREIGN PATENT DOCUMENTS

CA 518320 11/1955

(Continued)

OTHER PUBLICATIONS

Related pending U.S. Appl. No. 11/360,597, filed Feb. 24, 2006. Title: Bituminous Froth Hydrocarbon Cyclone. Inventors: Garner et al.

(Continued)

*Primary Examiner*—Thomas M Lithgow
(74) *Attorney, Agent, or Firm*—Knobbe Martens Olson & Bear LLP

(57) ABSTRACT

A system and process for concentrating hydrocarbons in a bitumen feed comprising bitumen, water and solids. The system comprises an inclined plate separator, a hydrocarbon cyclone and a centrifuge. The inclined plate separator separates the bitumen feed into a first overflow stream and a first underflow stream, the first overflow stream having a first bitumen concentration greater than that of the first underflow stream. The hydrocarbon cyclone separates the first underflow stream into a second overflow stream and a second underflow stream. The centrifuge separates the second overflow stream into a third overflow stream and a third underflow stream, the third overflow stream having a third bitumen concentration that is greater than that of the third underflow stream.

57 Claims, 9 Drawing Sheets

U.S. PATENT DOCUMENTS

| | | | | |
|---|---|---|---|---|
| 2,819,795 | A | 1/1958 | Cornelis | 209/732 |
| 2,910,424 | A | 10/1959 | Tek et al. | |
| 3,392,105 | A | 7/1968 | Poettmann et al. | 208/11 |
| 3,402,896 | A | 9/1968 | Daman | 241/38 |
| 3,607,720 | A | 9/1971 | Paulson | |
| 3,711,238 | A | 1/1973 | Dancy et al. | 431/173 |
| 3,798,157 | A | 3/1974 | Manzanilla et al. | 208/251 |
| 3,808,120 | A | 4/1974 | Smith | |
| 3,893,907 | A | 7/1975 | Canevari | 208/11 |
| 3,956,417 | A | 5/1976 | Franz et al. | |
| 3,962,070 | A | 6/1976 | Stotler | |
| 3,967,777 | A | 7/1976 | Canevari | 233/3 |
| 3,971,718 | A | 7/1976 | Reid | |
| 3,972,861 | A | 8/1976 | Gardner, Jr. et al. | |
| 3,998,702 | A | 12/1976 | Opoku | 196/14.52 |
| 4,017,263 | A | 4/1977 | Holmes et al. | |
| 4,035,282 | A | 7/1977 | Stuchberry et al. | |
| 4,036,664 | A | 7/1977 | Priebe | |
| 4,072,609 | A | 2/1978 | Kizior | |
| 4,090,943 | A | 5/1978 | Moll et al. | |
| 4,139,646 | A | 2/1979 | Gastrock | |
| 4,146,534 | A | 3/1979 | Armstrong | |
| 4,216,796 | A | 8/1980 | Gastrock | |
| 4,257,760 | A | 3/1981 | Schuurman et al. | 431/158 |
| 4,279,743 | A | 7/1981 | Miller | |
| 4,284,360 | A | 8/1981 | Cymbalisty et al. | 366/140 |
| 4,337,143 | A | 6/1982 | Hanson et al. | |
| 4,373,325 | A | 2/1983 | Shekleton | 60/39.06 |
| 4,378,289 | A | 3/1983 | Hunter | 209/211 |
| 4,383,914 | A | 5/1983 | Kizior | |
| 4,397,741 | A | 8/1983 | Miller | |
| 4,399,027 | A | 8/1983 | Miller | |
| 4,410,417 | A | 10/1983 | Miller et al. | 208/11 |
| 4,416,620 | A | 11/1983 | Morck | 431/348 |
| 4,470,262 | A | 9/1984 | Shekleton | 60/737 |
| 4,470,899 | A | 9/1984 | Miller et al. | 208/11 |
| 4,486,294 | A | 12/1984 | Miller et al. | 208/11 |
| 4,487,573 | A | 12/1984 | Gottschlich et al. | 431/348 |
| 4,505,811 | A | 3/1985 | Griffiths et al. | 209/13 |
| 4,514,305 | A | 4/1985 | Filby | |
| 4,545,892 | A | 10/1985 | Cymbalisty et al. | |
| 4,556,422 | A | 12/1985 | Reynolds et al. | |
| 4,558,743 | A | 12/1985 | Ryan et al. | 166/303 |
| 4,580,504 | A | 4/1986 | Beardmore et al. | 110/261 |
| 4,581,142 | A | 4/1986 | Fladby et al. | |
| 4,604,988 | A | 8/1986 | Rao | 126/360 |
| 4,744,890 | A | 5/1988 | Miller et al. | |
| 4,838,434 | A | 6/1989 | Miller et al. | |
| 4,851,123 | A | 7/1989 | Mishra | |
| 4,859,317 | A | 8/1989 | Shelfantook et al. | |
| 4,914,017 | A | 4/1990 | Mifune | |
| 4,994,097 | A | 2/1991 | Brouwers | |
| 5,029,557 | A | 7/1991 | Korenberg | 122/149 |
| 5,032,275 | A | 7/1991 | Thew | |
| 5,035,910 | A | 7/1991 | Jones | |
| 5,037,558 | A | 8/1991 | Kalnins | |
| 5,039,227 | A | 8/1991 | Leung et al. | 366/137 |
| 5,045,218 | A | 9/1991 | Prendergast et al. | 210/787 |
| 5,055,202 | A | 10/1991 | Carroll et al. | |
| 5,062,955 | A | 11/1991 | Sciamanna | |
| 5,071,556 | A | 12/1991 | Kalnins et al. | |
| 5,071,557 | A | 12/1991 | Schubert et al. | |
| 5,073,177 | A | 12/1991 | Brouwers | |
| 5,085,577 | A | 2/1992 | Muller | 431/265 |
| 5,090,498 | A | 2/1992 | Hamill | |
| 5,110,471 | A | 5/1992 | Kalnins | |
| 5,118,408 | A | 6/1992 | Jansen et al. | |
| 5,123,361 | A | 6/1992 | Nieh et al. | 110/264 |
| 5,143,598 | A | 9/1992 | Graham et al. | |
| 5,207,805 | A | 5/1993 | Kalen et al. | |
| 5,223,148 | A | 6/1993 | Tipman et al. | |
| 5,236,577 | A | 8/1993 | Tipman et al. | 208/390 |
| 5,242,580 | A | 9/1993 | Sury | |
| 5,242,604 | A | 9/1993 | Young et al. | |
| 5,264,118 | A | 11/1993 | Cymerman et al. | |
| 5,302,294 | A | 4/1994 | Schubert et al. | |
| 5,316,664 | A | 5/1994 | Gregoli et al. | |
| 5,340,467 | A | 8/1994 | Gregoli et al. | |
| 5,350,525 | A | 9/1994 | Shaw et al. | |
| 5,462,430 | A | 10/1995 | Khinkis | 431/10 |
| 5,556,545 | A | 9/1996 | Volchek et al. | |
| 5,572,956 | A | 11/1996 | Hallstrom et al. | 122/247 |
| 5,620,594 | A | 4/1997 | Smith et al. | |
| 5,667,543 | A | 9/1997 | Brouwers | |
| 5,667,686 | A | 9/1997 | Schubert | |
| 5,711,374 | A | 1/1998 | Kjos | |
| 5,740,834 | A | 4/1998 | Sherowski | |
| 5,832,846 | A | 11/1998 | Mankowski et al. | 110/345 |
| 5,840,198 | A | 11/1998 | Clarke | |
| 5,876,592 | A | 3/1999 | Tipman et al. | 208/390 |
| 5,879,541 | A | 3/1999 | Parkinson | |
| 5,958,256 | A | 9/1999 | Ocel, Jr. et al. | |
| 5,968,349 | A | 10/1999 | Duyvesteyn et al. | 208/390 |
| 5,996,690 | A | 12/1999 | Shaw et al. | |
| 6,036,475 | A | 3/2000 | Matsui et al. | 431/173 |
| 6,077,433 | A | 6/2000 | Henriksen et al. | |
| 6,119,870 | A | 9/2000 | Maciejewski et al. | |
| 6,167,818 | B1 | 1/2001 | Dejanovich | 110/264 |
| 6,189,613 | B1 | 2/2001 | Chachula et al. | |
| 6,190,543 | B1 | 2/2001 | Christiansen | 210/87 |
| 6,197,095 | B1 | 3/2001 | Ditria et al. | |
| 6,213,208 | B1 | 4/2001 | Skilbeck | |
| 6,315,837 | B1 | 11/2001 | Barclay | 134/10 |
| 6,322,845 | B1 | 11/2001 | Dunlow | |
| 6,346,069 | B1 | 2/2002 | Collier | |
| 6,378,608 | B1 | 4/2002 | Nilsen et al. | |
| 6,398,973 | B1 | 6/2002 | Saunder et al. | |
| 6,468,330 | B1 | 10/2002 | Irving et al. | |
| 6,543,537 | B1 | 4/2003 | Kjos | |
| 6,596,170 | B2 | 7/2003 | Tuszko et al. | |
| 6,607,437 | B2 | 8/2003 | Casey et al. | |
| 6,702,877 | B1 | 3/2004 | Swanborn | |
| 6,719,681 | B2 | 4/2004 | Collier | |
| 6,730,236 | B2 | 5/2004 | Kouba | |
| 6,800,116 | B2 | 10/2004 | Stevens et al. | |
| 6,800,208 | B2 | 10/2004 | Bolman | |
| 7,011,219 | B2 | 3/2006 | Knox-Holmes et al. | |
| 7,060,017 | B2 | 6/2006 | Collier | |
| 7,111,738 | B2 | 9/2006 | Allen, III | 209/172 |
| 7,140,441 | B2 | 11/2006 | Hauge et al. | |
| 7,141,162 | B2 | 11/2006 | Garner et al. | |
| 7,147,788 | B2 | 12/2006 | Tveiten | |
| 7,160,518 | B2 | 1/2007 | Chen et al. | 422/147 |
| 7,202,389 | B1 | 4/2007 | Brem | 585/242 |
| 7,223,331 | B2 | 5/2007 | Stark et al. | |
| 7,223,344 | B2 | 5/2007 | Zavattari et al. | |
| 7,250,140 | B2 | 7/2007 | Chen et al. | |
| 7,255,790 | B2 | 8/2007 | Rogers et al. | |
| 7,261,807 | B2 | 8/2007 | Henry et al. | |
| 7,261,870 | B2 | 8/2007 | Coulson et al. | |
| 7,314,441 | B2 | 1/2008 | Collier | 494/37 |
| 7,316,564 | B2 | 1/2008 | Muschelknautz et al. | 432/16 |
| 7,438,189 | B2 | 10/2008 | Garner et al. | 210/202 |
| 7,438,807 | B2 | 10/2008 | Garner | 210/202 |
| 2001/0005986 | A1 | 7/2001 | Matsubara et al. | |
| 2001/0042713 | A1 | 11/2001 | Conrad et al. | |
| 2001/0047964 | A1 | 12/2001 | Matherly et al. | 210/748 |
| 2002/0018842 | A1 | 2/2002 | Dunlow | |
| 2002/0068673 | A1 | 6/2002 | Collier | |
| 2002/0068676 | A1 | 6/2002 | Collier | |
| 2002/0148777 | A1 | 10/2002 | Tuszko | |
| 2003/0029775 | A1 | 2/2003 | Cymerman et al. | 208/187 |
| 2003/0085185 | A1 | 5/2003 | Kouba | |
| 2003/0127387 | A1 | 7/2003 | Aarebrot et al. | 210/634 |

| | | | | |
|---|---|---|---|---|
| 2003/0168391 | A1 | 9/2003 | Tveiten | |
| 2004/0055972 | A1 | 3/2004 | Garner et al. | |
| 2004/0069705 | A1 | 4/2004 | Tuszko et al. | |
| 2004/0094456 | A1 | 5/2004 | Dries | |
| 2004/0140099 | A1 | 7/2004 | Hauge et al. | |
| 2004/0182754 | A1 | 9/2004 | Lange | |
| 2004/0192533 | A1 | 9/2004 | Collier | |
| 2004/0262980 | A1 | 12/2004 | Watson | 299/8 |
| 2005/0016904 | A1 | 1/2005 | Knox-Holmes et al. | |
| 2005/0051500 | A1 | 3/2005 | Price et al. | 210/767 |
| 2005/0084812 | A1 | 4/2005 | Rakhmailov et al. | 431/1 |
| 2006/0084022 | A1 | 4/2006 | Kruger | 431/353 |
| 2006/0112724 | A1 | 6/2006 | Chang et al. | |
| 2006/0122449 | A1 | 6/2006 | van Egmond | |
| 2006/0138036 | A1 | 6/2006 | Garner et al. | |
| 2006/0138055 | A1 | 6/2006 | Garner et al. | 210/703 |
| 2006/0186038 | A1 | 8/2006 | Nassif | 210/512.1 |
| 2006/0217255 | A1 | 9/2006 | Collier | |
| 2006/0272983 | A1 | 12/2006 | Droughton et al. | |
| 2007/0014905 | A1 | 1/2007 | Chen et al. | |
| 2007/0095032 | A1 | 5/2007 | Nilsen et al. | |
| 2007/0114489 | A1 | 5/2007 | Powell et al. | 252/187.2 |
| 2007/0138085 | A1 | 6/2007 | Biester | |
| 2007/0179326 | A1 | 8/2007 | Baker | |
| 2007/0180741 | A1 | 8/2007 | Bjornson et al. | |
| 2007/0187321 | A1 | 8/2007 | Bjornson et al. | |
| 2007/0196257 | A1 | 8/2007 | Khattaty et al. | |
| 2007/0197845 | A1 | 8/2007 | Beech | |
| 2007/0202452 | A1 | 8/2007 | Rao | 431/354 |
| 2008/0000810 | A1 | 1/2008 | Garner et al. | 208/390 |
| 2008/0035586 | A1 | 2/2008 | Chen et al. | 210/788 |
| 2008/0149542 | A1 | 6/2008 | Bjornson et al. | 210/137 |
| 2008/0217212 | A1 | 9/2008 | Garner et al. | 208/390 |
| 2009/0134095 | A1 | 5/2009 | Hann | 210/741 |

FOREIGN PATENT DOCUMENTS

| | | | |
|---|---|---|---|
| CA | 680576 | 2/1964 | 196/18 |
| CA | 694547 | 9/1964 | 361/34 |
| CA | 741303 | 8/1966 | 196/23 |
| CA | 817869 | 7/1969 | 196/27 |
| CA | 970308 | 7/1975 | 196/17 |
| CA | 970309 | 7/1975 | 196/17 |
| CA | 970310 | 7/1975 | 196/24 |
| CA | 970311 | 7/1975 | 196/30 |
| CA | 971124 | 7/1975 | 196/23 |
| CA | 1005774 | 2/1977 | 196/17 |
| CA | 1026252 | 2/1978 | |
| CA | 1059052 | 7/1979 | |
| CA | 1066644 | 11/1979 | |
| CA | 1071130 | 2/1980 | 196/22 |
| CA | 1072439 | 2/1980 | 158/5 |
| CA | 1072473 | 2/1980 | |
| CA | 1076504 | 4/1980 | 196/24 |
| CA | 1097574 | 3/1981 | |
| CA | 1117353 | 2/1982 | 99/24.3 |
| CA | 1126187 | 6/1982 | |
| CA | 1138822 | 4/1983 | |
| CA | 1152918 | 8/1983 | 196/17 |
| CA | 1194622 | 1/1985 | |
| CA | 1201412 | 3/1986 | |
| CA | 1228288 | 10/1987 | 165/1 |
| CA | 1248476 | 1/1989 | 196/18 |
| CA | 1254171 | 5/1989 | |
| CA | 1266250 | 2/1990 | 196/22 |
| CA | 1267860 | 4/1990 | 196/18 |
| CA | 269063 | 5/1990 | 209/69 |
| CA | 2000984 | 4/1991 | 196/20 |
| CA | 2029795 | 5/1991 | 196/17 |
| CA | 2037856 | 9/1991 | |
| CA | 1283465 | 12/1991 | |
| CA | 1293465 | 12/1991 | 196/21 |
| CA | 2024756 | 5/1992 | |
| CA | 1305390 | 7/1992 | |
| CA | 2058221 | 7/1992 | |
| CA | 1313845 | 2/1993 | 209/70 |
| CA | 2049178 | 2/1993 | |
| CA | 2049793 | 2/1993 | |
| CA | 1318273 | 5/1993 | |
| CA | 1322177 | 9/1993 | |
| CA | 1325180 | 12/1993 | |
| CA | 2088227 | 4/1994 | |
| CA | 2108521 | 4/1994 | |
| CA | 2086073 | 6/1994 | |
| CA | 2155198 | 8/1994 | |
| CA | 2049793 | 6/1995 | |
| CA | 2184613 | 11/1995 | |
| CA | 2133911 | 4/1996 | |
| CA | 2149737 | 11/1996 | |
| CA | 2180686 | 2/1997 | |
| CA | 2231543 | 3/1997 | |
| CA | 2185256 | 3/1998 | |
| CA | 2263691 | 3/1998 | |
| CA | 2200899 | 9/1998 | |
| CA | 2217300 | 3/1999 | |
| CA | 2249679 | 4/1999 | |
| CA | 2308410 | 5/1999 | |
| CA | 2236183 | 10/1999 | |
| CA | 2269710 | 10/1999 | |
| CA | 2246841 | 3/2000 | |
| CA | 2365008 | 8/2000 | |
| CA | 2262343 | 10/2000 | |
| CA | 2298122 | 7/2001 | |
| CA | 2090618 | 10/2001 | |
| CA | 2358805 | 10/2001 | |
| CA | 2311738 | 11/2001 | |
| CA | 2409129 | 11/2001 | |
| CA | 2315596 | 2/2002 | |
| CA | 2332207 | 2/2002 | |
| CA | 857306 | 3/2002 | |
| CA | 873854 | 3/2002 | |
| CA | 882667 | 3/2002 | |
| CA | 910271 | 3/2002 | |
| CA | 2217300 | 8/2002 | |
| CA | 2350001 | 12/2002 | |
| CA | 2419325 | 8/2003 | |
| CA | 2400258 | 3/2004 | |
| CA | 2471048 | 3/2004 | |
| CA | 2527058 | 3/2004 | |
| CA | 2435113 | 1/2005 | |
| CA | 2436158 | 1/2005 | |
| CA | 2439436 | 3/2005 | |
| CA | 2532737 | 3/2005 | |
| CA | 2535702 | 3/2005 | |
| CA | 2537603 | 3/2005 | |
| CA | 2445645 | 4/2005 | |
| CA | 2483896 | 4/2005 | |
| CA | 2493677 | 6/2005 | |
| CA | 2549895 | 6/2005 | |
| CA | 2554725 | 6/2005 | |
| CA | 2454942 | 7/2005 | |
| CA | 2455623 | 7/2005 | |
| CA | 2462359 | 9/2005 | |
| CA | 2558424 | 10/2005 | |
| CA | 2467372 | 11/2005 | |
| CA | 2565980 | 12/2005 | |
| CA | 2510099 | 1/2006 | |
| CA | 2517811 | 2/2006 | |
| CA | 2538464 | 2/2006 | |
| CA | 2563922 | 3/2006 | |
| CA | 2520943 | 4/2006 | |
| CA | 2522031 | 4/2006 | |
| CA | 2580836 | 4/2006 | |
| CA | 2582078 | 4/2006 | |
| CA | 2506398 | 5/2006 | |
| CA | 2587866 | 6/2006 | |

| | | | |
|---|---|---|---|
| CA | 2494391 | 7/2006 | |
| CA | 2506398 | 11/2006 | |
| CA | 2547147 | 11/2006 | |
| CA | 2512227 | 1/2007 | |
| CA | 2524995 | 1/2007 | |
| CA | 2559833 | 1/2007 | |
| CA | 2505449 | 3/2007 | |
| CA | 2520223 | 3/2007 | |
| CA | 2560223 | 3/2007 | |
| CA | 2524110 | 4/2007 | |
| CA | 2526336 | 5/2007 | |
| CA | 2567644 | 5/2007 | |
| CA | 2567702 | 5/2007 | |
| CA | 2531007 | 6/2007 | |
| CA | 2531262 | 6/2007 | |
| CA | 2570231 | 6/2007 | |
| CA | 2550623 | 12/2007 | |
| CA | 2561539 | 3/2008 | |
| CA | 2610122 | 5/2008 | |
| CA | 2590300 | 11/2008 | |
| CA | 2540561 | 12/2009 | |
| CN | 1112033 | 11/1995 | |
| CN | 1701856 | 11/2005 | |
| DE | 3202358 | 8/1983 | |
| DE | 4239501 | 11/1993 | |
| DE | 4432395 | 3/1996 | |
| EP | 0021321 | 1/1981 | |
| EP | 0475467 A1 | 4/1987 | |
| EP | 262916 | 6/1988 | |
| EP | 355127 | 6/1989 | |
| EP | 0398864 A2 | 5/1990 | |
| EP | 0451343 A1 | 11/1990 | |
| EP | 0522686 A2 | 1/1993 | |
| EP | 332641 | 3/1994 | |
| EP | 0585100 | 3/1994 | |
| EP | 605746 | 7/1994 | |
| EP | 0699867 | 3/1996 | |
| EP | 0734751 A1 | 10/1996 | |
| EP | 0816756 | 1/1998 | |
| EP | 0866268 | 9/1998 | |
| EP | 1028811 | 8/2000 | |
| EP | 1069234 A1 | 1/2001 | |
| EP | 1087055 A1 | 3/2001 | |
| EP | 1166882 A3 | 7/2003 | |
| EP | 1445420 A2 | 8/2004 | |
| EP | 1600215 | 11/2005 | |
| EP | 1501636 | 8/2006 | |
| GB | 195055 | 1/1924 | |
| GB | 639468 | 6/1950 | |
| GB | 719379 | 12/1954 | |
| GB | 719380 | 12/1954 | |
| GB | 726841 | 3/1955 | |
| GB | 767944 | 2/1957 | ..... 91/117 |
| GB | 814610 | 6/1959 | |
| GB | 1015428 | 12/1965 | |
| GB | 1234455 | 6/1971 | |
| GB | 1262417 | 2/1972 | |
| GB | 1302064 | 1/1973 | |
| GB | 1425122 | 2/1976 | |
| GB | 2047735 | 1/1980 | |
| GB | 2062840 | 5/1981 | |
| GB | 2075543 | 11/1981 | |
| GB | 2116447 | 9/1983 | |
| JP | 57157951 | 9/1982 | |
| JP | 60251307 | 12/1985 | |
| JP | 61082856 | 4/1986 | |
| JP | 74616 | 1/1995 | |
| JP | 1182933 | 3/1999 | |
| RU | 2091668 | 9/1997 | |
| RU | 2154234 | 8/2000 | |
| UA | 79967 | 8/2007 | |
| WO | WO9115712 | 10/1991 | |
| WO | WO 92/04123 | 3/1992 | |
| WO | WO 94/23823 | 10/1994 | |
| WO | WO9610716 | 4/1996 | |
| WO | WO 00/74815 | 12/2000 | |
| WO | WO 03/068407 | 8/2003 | |
| WO | WO 03/092901 | 11/2003 | |
| WO | WO 2004/005673 | 1/2004 | |
| WO | WO 2005/044871 | 5/2005 | |
| WO | WO 2006/085759 | 8/2006 | |
| WO | WO 2006/132527 | 12/2006 | |
| WO | WO 2007/001174 | 1/2007 | |
| WO | WO 2007/021181 | 2/2007 | |
| WO | WO2007081816 | 7/2007 | |

OTHER PUBLICATIONS

Related pending U.S. Application No. 11/360,489, filed Feb. 24, 2006. Title: Bituminous Froth Inclined Plate Separator and Hydrocarbon Cyclone Treatment Process. Inventors: Garner et al.

Related pending U.S. Appl. No. 11/486,302, filed Jul. 13, 2006. Title: Bituminous Froth Inclined Plate Separator and Hydrocarbon Cyclone Treatment Process. Inventors: Garner et al.

Related pending U.S. Appl. No. 11/595,817, filed Nov. 9, 2006. Title: System, Apparatus and Process for Extraction of Bitumen From Oil Sands. Inventors: Bjornson et al.

National Energy Board, Canada's Oil Sands: A Supply and Market Outlook to 2015, An Energy Market Assessment Oct. 2000.

Krebs' Engineers, Krebs D-Series gMAX DeSanders for Oil and Gas, Bulletin 11-203WEL.

Eva Mondt "Compact Centrifugal Separator of Dispersed Phases" Proefschrift, Dec. 2005.

Natural Resources Canada, Treatment of Bitumen Froth and Slop Oil Tailings, Dec. 2001.

Rimmer, Gregoli and Yildlrim, "Hydrocyclone-based Process for Rejecting Solids from Oil Sands at the Mine Site While Retaining Bitumen for Transportation to a Processing Plant"; Suncor Extraction 3rd f1 pp. 93-100, Paper delivered on Monday Apr. 5, 1993 at a conference in Alberta, Canada entitled "Oil Sands-Our Petroleum Future".

Demco Cyclone Separators Catalog CI-78, Aug. 15, 1978.

Facts about liquid cyclones. Where to use them. Where not to use them. And how to specify the right cyclone for the job. With special emphasis on the DORRCLONE, 1979, Dorr-Oliver Inc.

Office Action dated Nov. 11, 2005 for U.S. Appl. No. 10/306,003 (issued as patent US 7,141,162).

Notice of Allowability dated Feb. 15, 2006 for U.S. Appl. No. 10/306,003 (issued as patent US 7,141,162).

Office Action dated Sep. 14, 2006 for U.S. Appl. No. 11/486,302.

Office Action dated Mar. 23, 2007 for U.S. Appl. No. 11/486,302.

Office Action dated Nov. 20, 2007 for U.S. Appl. No. 11/486,302.

Notice of Allowability dated Aug. 12, 2008 [issued as patent US 7,438,807 on Oct. 21, 2008].

Office Action dated Mar. 22, 2007 for U.S. Appl. No. 11/360,597.

Office Action dated Nov. 20, 2007 for U.S. Appl. No. 11/360,597.

Office Action dated Mar. 20, 2007 for U.S. Appl. No. 11/360,489.

Office Action dated Nov. 19, 2007 for U.S. Appl. No. 11/360,489.

Notice of Allowability dated Jun. 13, 2008 [issued as patent US 7438189 on Oct. 21, 2008].

Office Action dated Jun. 26 2009 for U.S. Appl. No. 12/123,381.

SYSTEM AND PROCESS FOR CONCENTRATING HYDROCARBONS IN A BITUMEN FEED

FIELD OF THE INVENTION

The present invention relates generally to a system and process for concentrating hydrocarbons in a bitumen feed comprising bitumen, water and solids.

BACKGROUND OF THE INVENTION

Oil sands deposits are found in over seventy countries throughout the world. However, a substantial portion of these deposits are located in the Alberta oil sands. In fact, Alberta's oil sands deposits contain the largest known reserve of oil in the world. The vast quantities of oil in these deposits creates a tremendous incentive to develop and improve upon techniques and systems for recovering them.

Oil sands are a geological formation, which are also known as tar sands or bituminous sands. Oil sands deposits are primarily composed of solids (generally mineral components such as clay, silt and sand) plus bitumen and water. The bitumen content typically constitutes up to about 21 wt. % of the bitumen-bearing formation material, with the remainder of the formation material composed of about 70 to 85 wt. % solids and about 4 to 10 wt. % water. The solids content typically includes clay and silt ranging from about 5 to 50 wt. %. Technically speaking, the bitumen is neither oil nor tar, but a semisolid form of oil which will not flow toward producing wells under normal conditions, making it difficult and expensive to produce.

Oil sand deposits are mined using strip mining techniques or persuaded to flow into producing wells by techniques such as steam assisted gravity drainage (SAGD) or cyclic steam stimulation (CSS) which reduce the bitumen's viscosity with steam, solvents or a combination of steam and solvents.

In order to produce an appropriate quality of bitumen-based product for use by a refinery, the hydrocarbons in the bitumen-bearing formation material removed from oil sands deposits need to be concentrated. Concentrating the hydrocarbon content of a bitumen-bearing material (also known as bitumen recovery) is typically carried out through primary and secondary treatment processes that are well known in the art.

In conventional primary treatment facilities, the bitumen-bearing formation material is processed to produce a bitumen-enriched froth stream, which typically has a bitumen content of about 50 to 60 wt. %, a solids content of about 10 to 15 wt. % and a water content of about 30 to 40 wt. %. The bitumen-enriched froth stream that is produced through primary treatment is typically transported to a secondary treatment facility to increase its hydrocarbon concentration further in order to make it suitable for processing by an upgrader or specialized refinery facility. In order to make use of the bitumen-enriched froth stream in an upgrader or refinery, secondary treatment facilities process the stream in order to produce a hydrocarbon-rich product having a hydrocarbon concentration typically in the range of at least about 90% to 97% wt. % or more. Various techniques may be used to enhance the hydrocarbon concentration of the bitumen-enriched froth stream produced by primary treatment processes, examples of which can be found in Canadian Patent Nos. 873,854, 882,667 and 2,400,258.

Although various treatment processes exist to produce a bitumen-enriched product suitable for use by an upgrader or refinery, there continues to be a need for further treatment processes and systems that offer enhancements or alternatives to the manner in which a bitumen-enriched froth stream from primary treatment is processed.

SUMMARY OF THE INVENTION

In one aspect of the present invention there is provided a process for concentrating hydrocarbons in a bitumen feed comprising bitumen, water and solids. With this process the bitumen feed is separated, in an inclined plate separator, into a first overflow stream and a first underflow stream, with the first overflow stream having a first bitumen concentration greater than that of the first underflow stream. The first underflow stream is processed by a first cyclone, which separates the first underflow stream into a second overflow stream and a second underflow stream. The second overflow stream is processed by a first centrifuge, which separates the second overflow stream into a third overflow stream and a third underflow stream. With this process, the third overflow stream has a third bitumen concentration that is greater than that of the third underflow stream. In addition, the first overflow stream and the third overflow stream each are suitable for use by an upgrader.

In another aspect of the present invention, there is provided a system for concentrating hydrocarbons in a bitumen feed comprising bitumen, water and solids. The system comprises means for separating, in an inclined plate separator, the bitumen feed into a first overflow stream and a first underflow stream, the first overflow stream having a first bitumen concentration greater than that of the first underflow stream. The system also comprises means for separating, in a first cyclone, the first underflow stream into a second overflow stream and a second underflow stream, the second overflow stream having a second bitumen concentration greater than that of the second underflow stream. In addition, the system comprises means for separating, in a first centrifuge, the second overflow stream into a third overflow stream and a third underflow stream, the third overflow stream having a third bitumen concentration that is greater than that of the third underflow stream.

In yet another aspect of the present invention, there is provided a system for concentrating hydrocarbons in a bitumen feed comprising bitumen, water and solids, the system comprising an inclined plate separator, a cyclone and a centrifuge. With this aspect, the inclined plate separator separates the bitumen feed into a first overflow stream and a first underflow stream, the first overflow stream having a first bitumen concentration greater than that of the first underflow stream. The first cyclone separates the first underflow stream into a second overflow stream and a second underflow stream. The first centrifuge separates the second overflow stream into a third overflow stream and a third underflow stream, wherein the first overflow stream and the third overflow stream each comprise about or less than about 1.0 wt. % solids.

BRIEF DESCRIPTION OF THE DRAWINGS

In the accompanying drawings which illustrate embodiments of the invention.

DETAILED DESCRIPTION

Reference will now be made in detail to implementations and embodiments of various aspects and variations to the present invention, examples of which are illustrated in the accompanying drawings.

Figure 1:
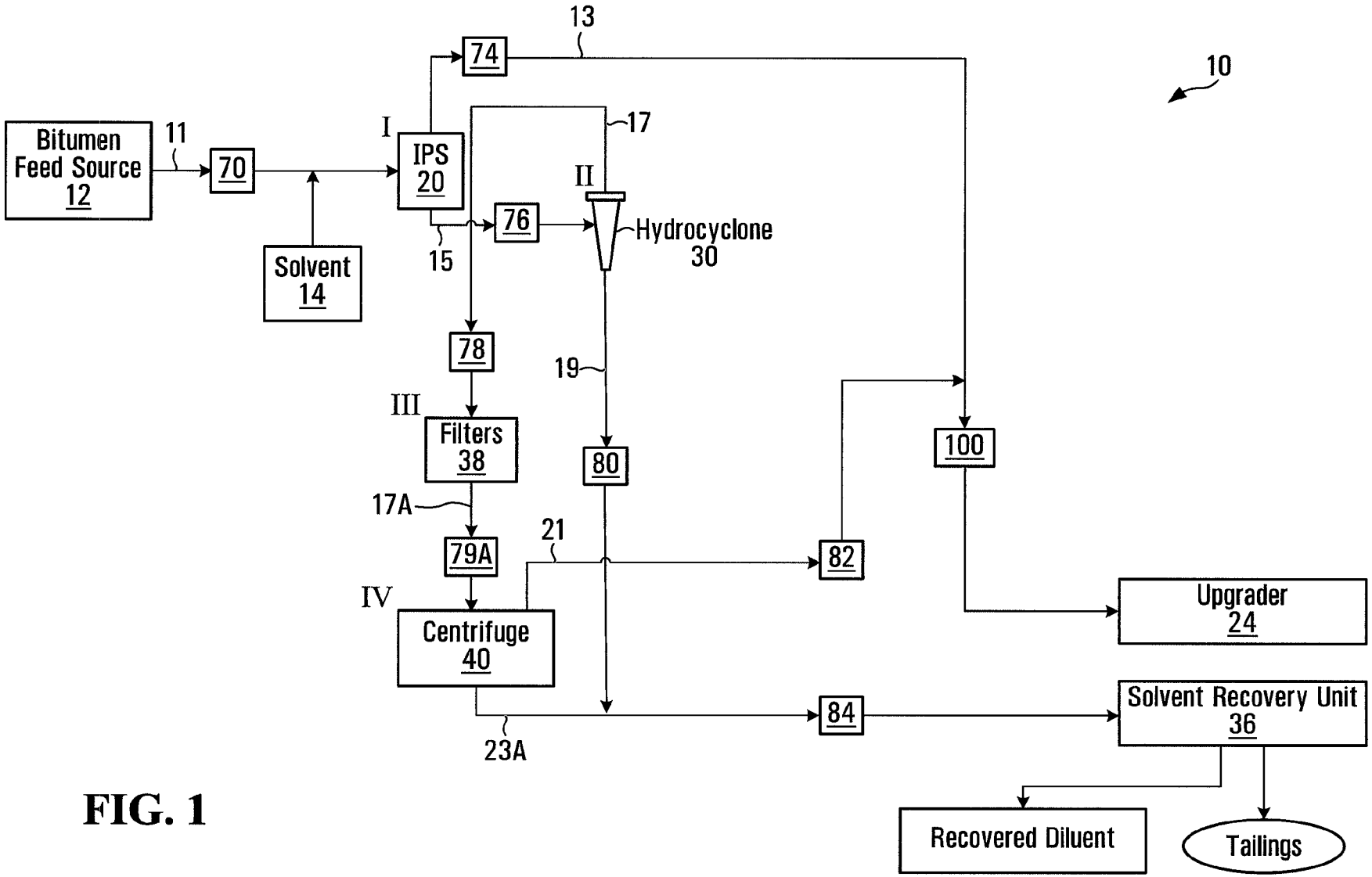
FIG. 1 illustrates a treatment system for concentrating hydrocarbons in a bitumen-rich froth feed according to a first embodiment of the present invention.

Referring to FIG. 1, there is shown a first embodiment of a system 10 adapted for concentrating hydrocarbons in a bitumen feed in accordance with one aspect of the present invention. The system 10 comprises a plurality of separation stages (including at least stages I, II, III), each having at least one separation unit to assist in the staged concentration of hydrocarbons in the bitumen feed. As illustrated in the first embodiment, in one aspect of the present invention, the separation units comprise an inclined plate separator 20 at separation stage I, a first hydrocarbon cyclone 30 at separation stage II, a set of filters 38 at separation stage III and a first centrifuge 40 at separation stage IV, which are operably configured to provide the system 10 for concentrating hydrocarbons in a bitumen feed stream 70. For the purposes of this specification, hydrocarbon cyclones are also referred to as "hydrocyclones" or simply as cyclones.

As illustrated in FIG. 1, a bitumen feed source 12 provides the source of bitumen enriched feed which is supplied to a conduit or line 11 as a bitumen feed stream 70. The bitumen feed source 12 may be a storage tank or facility, a primary separation vessel or another treatment system upstream of the system 10. The bitumen feed stream 70 serves as an input stream to the system 10 and is fed through line 11 to the inclined plate separator 20 for processing. In the first embodiment, the bitumen feed stream 70 is a bitumen froth stream that will typically have the consistency of deaerated froth. In this specification, the term "bitumen froth" means a mixture of air, water, bitumen and solids, which is typically formed upstream of the system 10 using an oil sands primary separation vessel or another separation unit upstream of the system 10 to initially produce a bitumen-enriched froth.

The bitumen feed stream 70 will typically have a varying degree of constituent components (bitumen, water and solids) due to, for instance, variations in the oil sands composition processed upstream of the system 10. Typically, the bitumen feed stream 70 comprises from about 45 to 65 wt. % bitumen, from about 8 to 15 wt. % solids and from about 25 to 50 wt. % water.

In the first embodiment, a solvent 14 comprising a liquid hydrocarbon is added to the bitumen feed stream 70 to reduce its hydrocarbon density and its viscosity. Preferably, the addition of the solvent 14 also helps solvate the hydrocarbons from solids in the bitumen feed stream 70 and from organic films surrounding water droplets in the bitumen feed stream 70. The solvent 14 may be any solvent capable of diluting the bitumen feed stream 70 so as to reduce the hydrocarbon density and the viscosity of the bitumen feed stream 70. In the first embodiment, the solvent 14 may comprise naphtha.

Alternatively, other solvents may be used including, for example, paraffinic or alkane hydrocarbon solvents. In this specification, the solvent 14 is also referred to as a diluent. The solvent 14 is preferably miscible with the hydrocarbon components of the bitumen feed stream 70, and preferably can be readily recovered from the hydrocarbon components of the bitumen feed stream 70.

The solvent 14 can be added at one or more addition points within or in advance of the system 10. In the first embodiment, the solvent 14 is added in advance of introducing the bitumen feed stream 70 to the inclined plate separator 20 in separation stage I. In the alternative, the solvent 14 may be added to or mixed with one or more other streams of the system 10 in addition to or instead of the bitumen feed stream 70. In this specification the term "hydrocarbons" refers to the hydrocarbons found in the bitumen, the solvent 14 (diluent) or both.

The diluted bitumen feed stream 70 is fed through line 11 to the inclined plate separator 20. The inclined plate separator 20 is a conventional inclined plate separator which processes an incoming bitumen feed stream so as to produce a bitumen-enriched product stream comprising a bitumen concentration suitable for processing by an upgrader 24, and a residual bitumen-lean stream (also referred to as a reject stream) comprising a concentration of bitumen lower than that in the product stream. Inclined plate separators are well known in the art. For illustration purposes only, inclined plate separators that may be used in system 10 include inclined plate separators available from Krebs Engineers (www.krebs.com) or from Parkson Industrial Equipment Company of Florida, U.S.A.

As illustrated in FIG. 1, the inclined plate separator 20 separates the incoming diluted bitumen feed stream 70 into a first overflow stream 74 and a first underflow stream 76. The first overflow stream 74 is a bitumen-enriched product stream. Preferably, at least about 60 wt. % of the bitumen found in the bitumen feed stream 70 will be concentrated in the bitumen-enriched product stream formed by the first overflow stream 74. More preferably at least about 70 wt. % of the bitumen found in the bitumen feed stream 70 will be concentrated in the first overflow stream 74.

The first overflow stream 74 typically comprises from about 55 wt. % to about 65 wt. % bitumen; from about 30 wt. % to about 40 wt. % diluent; from about 0.5 wt. % to about 2.0 wt. % solids; and from about 1.0 wt. % to about 6.0 wt. % water. Preferably, the first overflow stream 74 in FIG. 1 has a D/B ratio (diluent to bitumen weight ratio) of about 0.45 to about 0.62. The first overflow stream 74 also preferably comprises a hydrocarbon content of about 93 wt. % to about 98 wt. %.

The first overflow stream 74 is fed to line 13, and may be sent directly to the upgrader 24. Alternatively, the first overflow stream 74 may be directed to a storage unit. In another aspect, the first overflow stream 74 may be further processed before being supplied to the upgrader 24.

Although the first underflow stream 76 comprises a hydrocarbon concentration which is significantly lower than that of the first overflow stream 74, the first underflow stream 76 typically will still contain bitumen that will be desirable to recover for processing by the upgrader 24. Therefore, the first underflow stream 76 is fed through line 15 to separation stage II for further treatment within the system 10.

As shown in FIG. 1, the first underflow stream 76 is fed to a first hydrocyclone 30 in separation stage II. The first hydrocyclone 30 provides an intermediate mechanism within the system 10 for processing the first underflow stream 76 in order to concentrate a further hydrocarbon component (bitumen and diluent) by separating out a portion of water and solids from the first underflow stream 76. Hydrocyclones are well known by persons skilled in the art. In the first embodiment, for illustration purposes, the first hydrocyclone 30 is of the type shown in FIG. 2 of Canadian Patent No. 2,400,258. However, in other alternatives, other conventional hydrocyclones may be used. For example, other suitable hydrocyclones include those manufactured by Krebs Engineers (www.krebs.com).

The first hydrocyclone 30 separates the first underflow stream 76 into a second overflow stream 78 and a second underflow stream 80. The second overflow stream 78 has a significantly higher hydrocarbon concentration (bitumen and diluent) than that of the second underflow stream 80. In addition, the second overflow stream 78 will have significantly lower solids and water contents than those of the second underflow stream 80.

The second overflow stream 78 is an intermediate stream comprising a hydrocarbon concentration which is lower than the hydrocarbon concentration of the first overflow stream 74. However, the second overflow stream 78 typically will still contain hydrocarbons that are desirable to recover as part of the final product stream that may be used by an upgrader. One of the challenges with concentrating hydrocarbons from this intermediate stream (second overflow stream 78) is the desire to efficiently produce a secondary product stream that comprises concentrated hydrocarbons (bitumen and diluent) from the intermediate stream (second overflow stream 78) while maintaining a quality of the secondary product stream suitable for further processing in the upgrader 24. In this regard, having a secondary product stream, produced by the system 10 from the processing (treatment) of the second overflow stream 78, comprising less than about 4.0 wt. % solids and less than about 6.0 wt. % water has been found to be of suitable quality for use by the upgrader 24. However, having a secondary product stream comprising even lower solids and water contents is much more preferred in order to enhance hydrocarbon concentration, improve the performance of the upgrader 24, and reduce its maintenance requirements. Preferably, the product stream to be fed to the upgrader 24 (overflow stream 74 or the secondary product stream) comprises less than about 2.0 wt. % solids, more preferably comprises less than about 1.4 wt. % solids, more preferably comprises less than about 1.2 wt. % solids and more preferably yet comprises less than about 1.1 wt. % solids and even more preferably yet comprises less than 0.5 wt. % solids. Preferably, the product stream to be fed to the upgrader 24 also comprises less than about 3.0 wt. % water, more preferably comprises less than about 1.5 wt. % water, and more preferably yet comprises about or less than about 1.0 wt. % water. It has been found that keeping the water content at about 1.5 wt. % or less in the product stream (overflow stream 74 or the secondary product stream) to be fed to the upgrader 24 is particularly preferably as this contributes to a substantial decrease in the number of erosion/corrosion events seen in the upgrader 24 due to chlorides, which advantageously results in much less wear on the upgrader equipment, significantly fewer maintenance requirements, and significantly less degredation in the operation of the upgrader and fewer undesirable interruptions in operations.

The second overflow stream 78 is preferably fed via line 17 to a filtration-based separation stage III comprising one or more filters 38, such as Cunos™ filters, which are used to filter out a portion of the solids (including tramp or trash material) in the second overflow stream 78. The filtration of the second overflow stream 78 by filters 38 results in filtered stream 79, which is fed through line 17A to separation stage IV.

Separation stage IV, comprising first centrifuge 40, forms part of the system 10 in order to further improve the quality of the secondary product stream that will be produced and eventually be available for processing by the upgrader 24. In this regard, the addition of first centrifuge 40 within the system 10 provides a mechanism for further enhancing the concentration of hydrocarbons (bitumen and diluent) from the second overflow stream 78 and for reducing the quantity of contaminants (e.g. solids and water) in the secondary product stream that is produced for eventual use by the upgrader 24.

It has been found that keeping the solids content (coarse and fine solids) at about 1.0 wt. % or less in the product stream to be fed to the upgrader 24 is particularly preferably as this contributes to a substantial decrease in the number of erosion events seen in the upgrader 24, which advantageously results in much less wear on the upgrader equipment, significantly fewer maintenance requirements, and significantly less degredation in the operation of the upgrader and fewer undesirable interruptions in operations. Achieving a product stream comprising about or less than about 1.0 wt. % solids from the processing of an intermediate stream such as second overflow stream 78 can be challenging due to the high mineral content in the second overflow stream 78 resulting from the separation techniques applied by the inclined plate separator 20 and the first hydrocyclone 30. The introduction of the first centrifuge 40 to the system 10 and the processing of second overflow stream 78 by the first centrifuge 40, preferably after filtration through filters 38, advantageously assists significantly in keeping the solids content in the secondary product stream 82 at about 1.0 wt. % or less during the extended and continuing operation of the system 10. In addition, feeding the second overflow stream 78 to the first centrifuge 40 rather than to or upstream of the inclined plate separator 20 avoids placing additional circulating load on the inclined plate separator 20 and avoids raising the solids and water content of the first overflow stream 74 and the first underflow stream 76 that would result from re-introducing to the inclined plate separator 20 additional solids-rich material downstream of the inclined plate separator 20.

In FIG. 1, the second overflow stream 78 is fed through line 17, filters 38 and line 17A to the first centrifuge 40. The first centrifuge 40 separates out a portion of the remaining fine solids (i.e., minerals or other particulates such as clays having particle sizes of less than about 44 microns) dispersed in water from the second overflow stream 78 to produce a third overflow stream 82 (i.e. the secondary product stream in FIG. 1) and a third underflow stream 84, with the third underflow stream 84 comprising the removed portion of the remaining fine solids and water. Preferably, the first centrifuge 40 is capable of removing a significant portion of fine solids from the second overflow stream 78 so that the third overflow stream 82 comprises a lower fine solids content than the fine solids content of the second overflow stream 78. More preferably, the third overflow stream 82 comprises a significantly lower fine solids content than that of the second overflow stream 78. In the first embodiment, the first centrifuge 40 is a disk centrifuge produced by Westfalia, although other centrifuges capable of removing a significant portion of fine solids from a feed stream may also be used.

The introduction of the first centrifuge 40 at separation stage III and the feeding of at least the second overflow stream 78 to the first centrifuge 40, preferably via filters 38, advantageously provides a configuration that not only can produce a secondary product stream (third overflow stream 82) that has about 1.0 wt % solids content or less, but in which the solids content can typically be maintained over continued operation at about 0.4 wt. % to about 0.8 wt. %. In addition, the third overflow stream 82 will have a significantly higher hydrocarbon concentration (bitumen and diluent) than that of the third underflow stream 84, and will have significantly lower solids and water contents than those of the third underflow stream 84. The third overflow stream 82 typically comprises from about 54 wt. % to about 60 wt. % bitumen; from about 33 wt. % to about 39 wt. % diluent; from about 0.4 wt. % to about 0.8 wt. % solids; and from about 5.0 wt. % to about 12.0 wt. % water. In addition, the third overflow stream 82 typically has a D/B weight ratio of about 0.6 to about 0.7 and comprises a hydrocarbon content of about 88 wt. % to about 95.5 wt. %.

The third overflow stream 82 produced in the system 10 will preferably have a sufficiently high concentration of hydrocarbons (bitumen and diluent) and a sufficiently low concentration of contaminants (e.g. solids and water) such that the third overflow stream 82 is of a quality suitable to be used by the upgrader 24. In the first embodiment, the third overflow stream 82 is fed through line 21 and combined with the first overflow stream 74 in line 13 to produce a combined product stream 100 for use by the upgrader 24.

In the first embodiment, the second underflow stream 80 and the third underflow stream 84 are reject streams, which may be combined and fed to a solvent recovery unit 36 in order to recover the residual solvent 14 (diluent) for reuse within the system 10 before the combined reject stream (80 and 84) is sent to a tailings pond (not shown).

In one aspect of the present invention, the staged system 10 shown in FIG. 1 or any of the systems shown in the other figures that follow provide for a higher gravitational G-force in the gravitational-based separation applied to produce product streams having concentrated substantially all of the hydrocarbons initially present in the input bitumen feed stream 70. In this aspect, the system 10 in FIG. 1 for example comprises separation stages wherein the gravitational separation forces applied by the first hydrocyclone 30 are at least significantly higher than those applied by the inclined plate separator 20, and the gravitational separation forces applied by the first centrifuge 40 are substantially higher than those applied by the first hydrocyclone 30. In this regard, the inclined plate separator 20 has a gravitational separation force of about 1 G; the first hydrocyclone 30 typically has a gravitational separation force of about 200 to about 700 Gs, and the first centrifuge 40 has a gravitational separation force greater than that of the first hydrocyclone 30, preferably at least about 800 Gs.

Although not shown in FIG. 1 or the other figures that follow, it will be understood that ancillary elements and machinery such as pumps, intermediate valves and the like will be used for proper operation of the embodiments shown. These ancillary elements will be well understood to those skilled in the art. In addition, although separation stages in FIG. 1 or in the figures that follow are shown, for illustration purposes, as using a single separation unit in each stage, multiple separation units can be used in each separation stage of the first embodiment (e.g. multiple inclined plate separators in stage I, multiple hydrocyclones in stage II or multiple centrifuges in stage IV), and in other embodiments depending upon the operational scale of the facility implementing one or more of the aspects of the present invention.

In addition to the various aspects and features discussed above, the system 10 and the process applied thereto can have a variety of aspects and features to further enhance operations. Furthermore, as with the aspects and features described above, each of the following aspects and features individually provides a beneficial enhancement and is an embodiment of the present invention. These additional aspects and features will now be described below.

Figure 2:
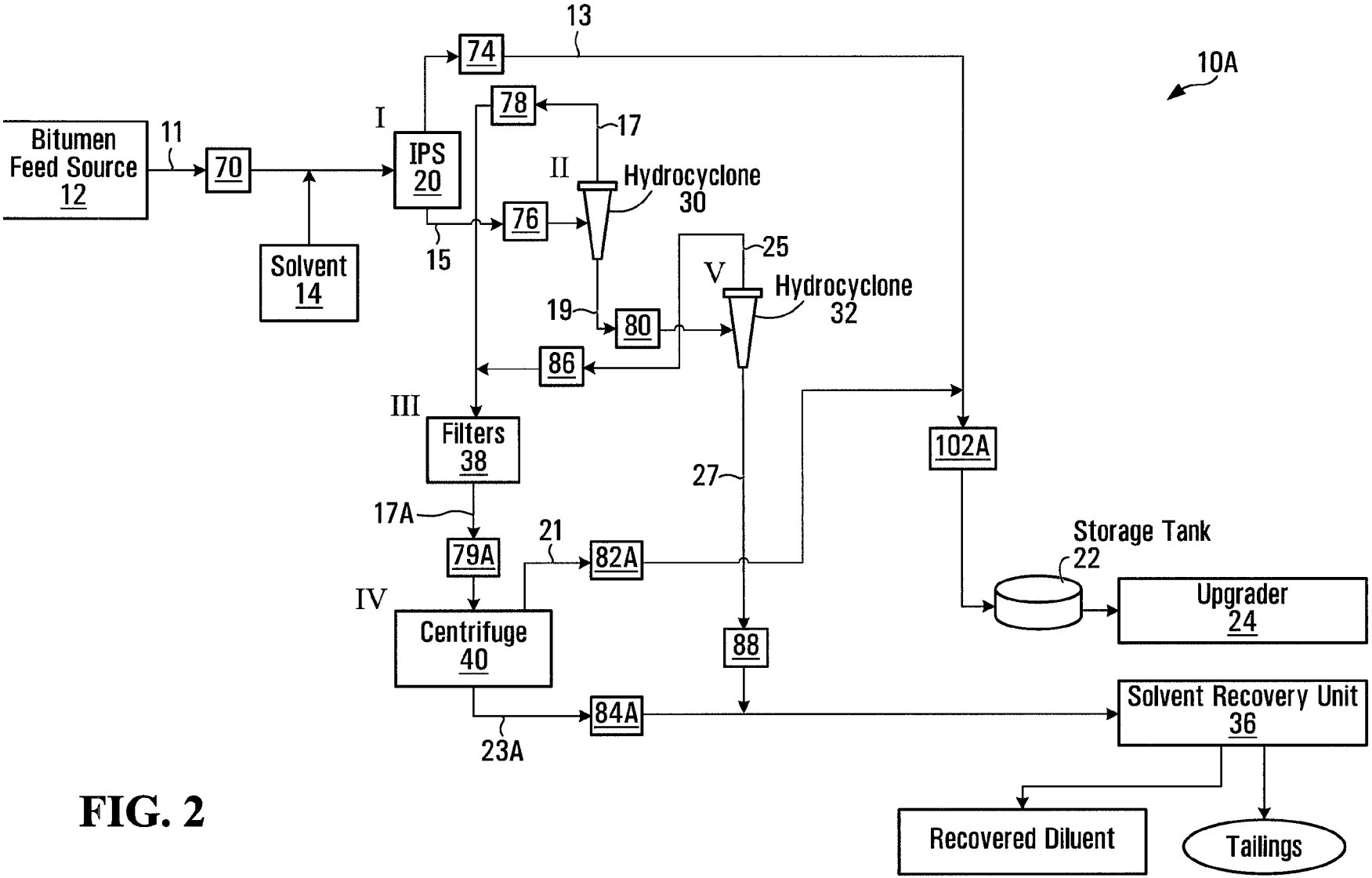
FIG. 2 illustrates a treatment system for concentrating hydrocarbons in a bitumen-rich froth feed according to another embodiment of the present invention.

Referring to FIG. 2, there is shown another embodiment (system 10A) in which, in another aspect of the present invention, a second hydrocyclone 32 is included in a variation of the system 10 shown in FIG. 1. In the embodiment shown in FIG. 2, the second underflow stream 80 from the first hydrocyclone 30 in separation stage II is fed as an input stream to the second hydrocyclone 32 in separation stage V through line 19. The second hydrocyclone 32 forms a further separation stage, in which the second underflow stream 80 is processed to concentrate a portion of the residual hydrocarbons (bitumen and diluent) remaining in the second underflow stream 80. As shown in FIG. 2, the second underflow stream 80 is separated by the second hydrocyclone 32 into a fourth overflow stream 86 and a fourth underflow stream 88. The fourth overflow stream 86 will have a hydrocarbon concentration (bitumen and diluent) higher than that of the fourth underflow stream 88. In addition, the fourth overflow stream 86 will have lower solids and water contents than those of the fourth underflow stream 88. The fourth underflow stream 88 is treated as a reject stream which is fed through line 27, and eventually supplied to the solvent recovery unit 36 to recover residual solvent 14 for reuse.

The fourth overflow stream 86 is fed through line 25, and is combined (blended) with the second overflow stream 78 in line 17 to form a combined stream, which preferably is fed to filters 38 to filter out a portion of the solids in the combined stream. The filtration of the combined stream formed by second overflow stream 78 and fourth overflow stream 86 by filters 38 results in filtered stream 79A, which is fed through line 17A to the first centrifuge 40 for processing as described in connection with the first embodiment shown in FIG. 1. The first centrifuge 40 separates the incoming filtered stream 79A into an overflow stream 82A and an underflow stream 84A. The overflow stream 82A that is produced preferably contains a sufficiently high hydrocarbon concentration and a sufficiently low solids and water content that the overflow stream 82A is of a quality suitable for use by upgrader 24. Optionally, the overflow stream 82A may be fed to a storage tank 22. The underflow stream 84A is a reject stream, which is fed to the solvent recovery unit 36 to recover residual solvent 14 for reuse within the system 10A.

Figure 3:
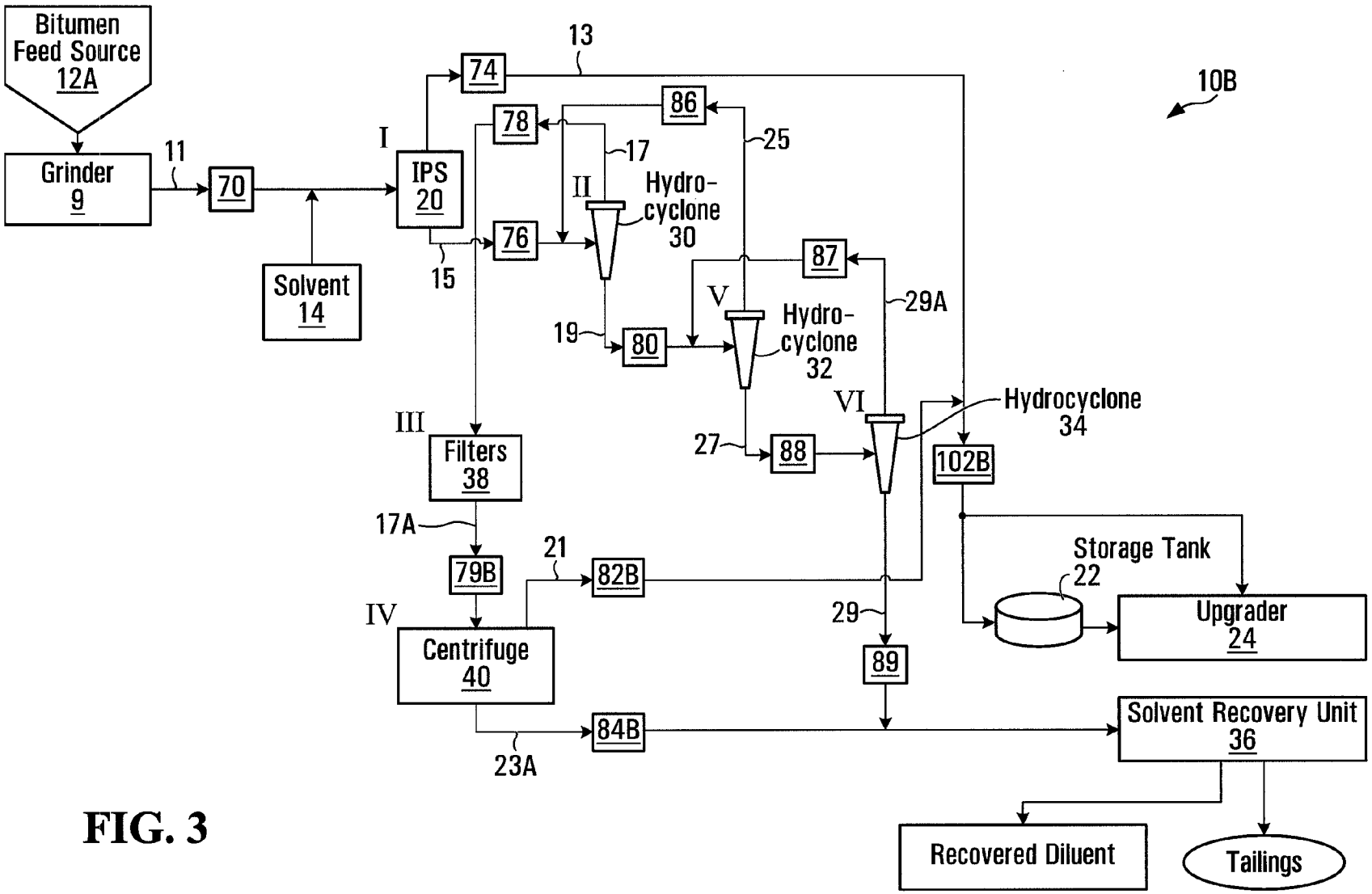
FIG. 3 illustrates a treatment system for concentrating hydrocarbons in a bitumen-rich froth feed according to another embodiment of the present invention.

Referring to FIG. 3, there is shown another embodiment (system 10B) in which, in another aspect of the present invention, a third hydrocyclone 34 is included in a variation of the system 10A shown in FIG. 2. In the embodiment shown in FIG. 3, a bitumen feed source 12A comprising an inter-stage storage tank is used to hold an inventory of deaerated bitumen froth for the system 10B. The inter-stage storage tank has a conical bottom in order to minimize the amount of particulate build-up that can arise at the bottom of the tank and in order to assist in maintaining the consistency of the deaerated bitumen froth. Preferably, the deaerated bitumen froth from the inter-stage storage tank (12A) is fed to a grinder 9, such as a Macho Muncher™ available from JWC Environmental of Costa Mesa, Calif. The deaerated bitumen froth that serves as a feed source may contain various organic materials, such as pieces of roots, branches, coal, other carbonaceous material and the like, which may obstruct or plug up over time the system 10B. In the embodiment shown in FIG. 3, such organic materials are reduced in size before the deaerated bitumen forth is processed by the various separation stages.

The grinder 9 grinds pieces of roots, branches, coal and other organic materials to a size small enough not to plug pumps or separation units within the system 10B, preferably down to about ¼ inch in diameter or less. By grinding down pieces of material in the deaerated bitumen froth that could obstruct parts of the system 10B, the deaerated bitumen froth can be fed to the separation units while avoiding bitumen recovery losses that would arise from the pre-treatment removal of such obstructions. The bitumen feed 70 (deaerated bitumen froth) is then fed through line 11 for further processing in the manner described in the above embodiments (systems 10 and 10A). Alternatively, grinder 9 may be situated to process diluted bitumen streams. For instance, the grinder 9 may be situated to process bitumen feed stream 70 after solvent 14 is added or to process first underflow stream 76.

As shown in FIG. 3, the system 10B includes three hydrocyclone separation stages II, V and VI which respectively comprise hydrocyclones 30, 32 and 34. The hydrocyclones 30, 32 and 34 in separation stages II, V and VI form an intermediate counter-current circuit within the system 10B and serve to recondition or "wash" the first underflow stream 76 produced by the inclined plate separator 20. With the system 10B, additional hydrocarbons that would not otherwise be recovered in the second overflow stream 78 obtained from the initial processing by the first hydrocyclone 30 (in the first embodiment shown in FIG. 1) of the first underflow stream 76 are concentrated in the fourth overflow stream 86 produced by the second hydrocyclone 32, and reintroduced via line 25 into the first underflow stream 76 in line 15 for further processing by the first hydrocyclone 30. Similarly, yet additional hydrocarbons that were not concentrated in the fourth overflow stream 86 from the processing of the second underflow stream 80 by the second hydrocyclone 32 are concentrated from the fourth underflow stream 88 by the third hydrocyclone 34 in separation stage VI, and reintroduced via line 29A as part of further overflow stream 87 to line 19 for further processing by the second hydrocyclone 32 in separation stage V. The introduction of the intermediate counter-current circuit in system 10B provides for an enhanced concentration of hydrocarbons in the second overflow stream 78, and can improve operational efficiency and power requirements.

In the embodiment shown in FIG. 3, the second overflow stream 78 in line 17 is preferably fed to filters 38 to filter out a portion of the solids (including tramp or trash material) which results in a filtered stream 79B that is fed through line 17A to the first centrifuge 40 for processing as described in connection with the embodiment shown in FIG. 1. The first centrifuge 40 separates the filtered stream 79B into an overflow stream 82B and an underflow stream 84B.

The overflow stream 82B will have a higher hydrocarbon concentration (bitumen and diluent) than that of the underflow stream 84B, and will have a significantly higher bitumen concentration than that of the underflow stream 84B. The overflow stream 82B will also have significantly lower solids and water contents than those of the underflow stream 84B. As compared to the first embodiment in FIG. 1, the overflow stream 82B will also have a higher hydrocarbon concentration and a higher bitumen concentration than those of the overflow stream 82.

It will be noted that the intermediate three-stage counter-current circuit shown in FIG. 3 is illustrative, and that in other variations, other intermediate multi-stage counter-current circuits could be used. For example, in another variation, the system 10B may comprise separation stages II and V, but no separation stage VI, with the underflow stream 88 of the second hydrocyclone 32 being fed to the underflow stream 84B in line 23A rather than being processed through a further processing cycle.

Figure 4:
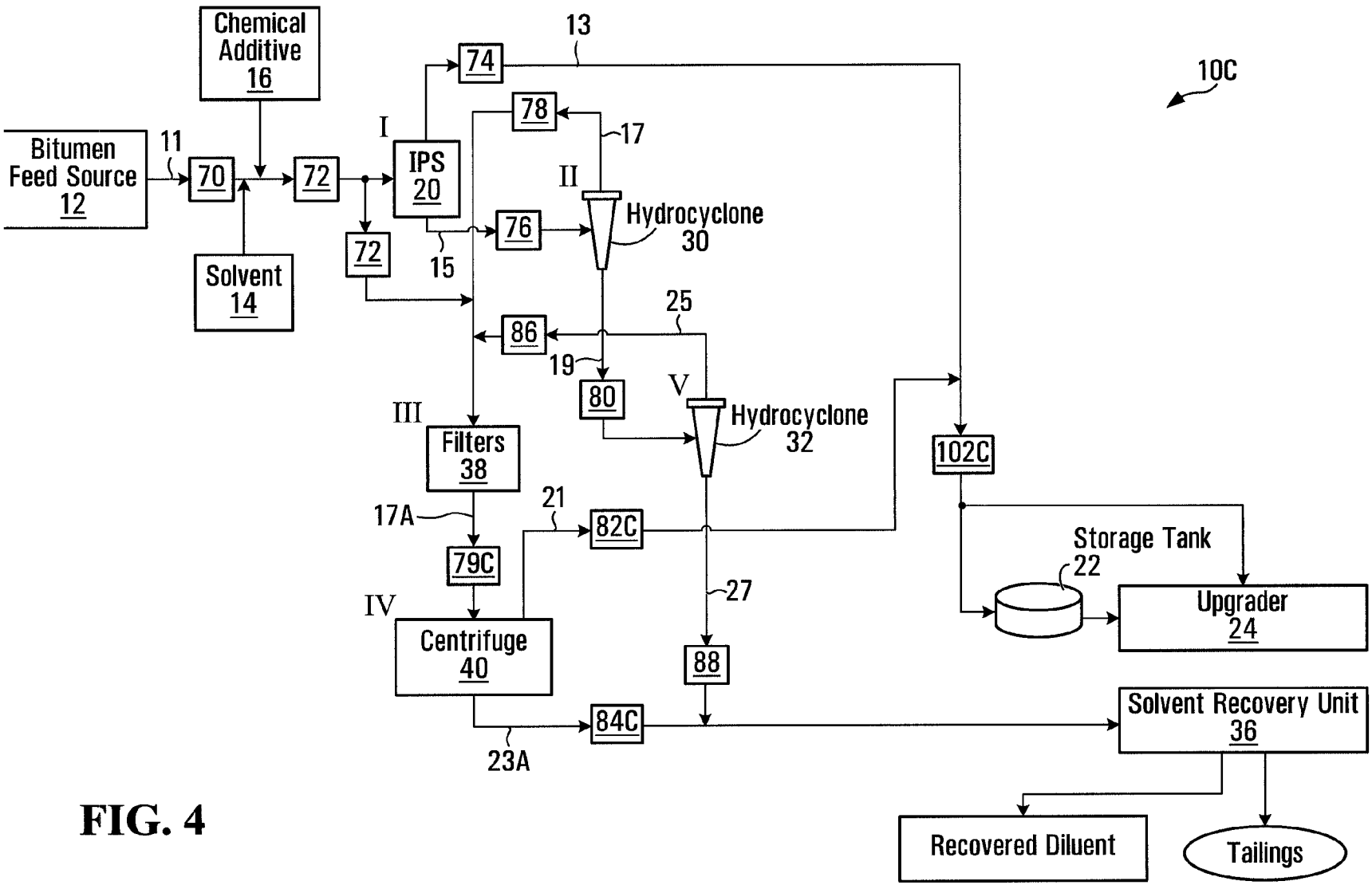
FIG. 4 illustrates a treatment system for concentrating hydrocarbons in a bitumen-rich froth feed according to another embodiment of the present invention.

Referring to FIG. 4, there is shown a variation of the system 10A illustrated in FIG. 2. In FIG. 4, the system 10C includes the optional addition of a chemical additive 16, such as a demulsifier or surfactant, to promote or enhance phase separation. As also illustrated in FIG. 4, preferably solvent 14, in the form of a diluent, is introduced to the bitumen feed stream 70 resulting in diluted feed stream 72. Diluted feed stream 72 typically comprises from about 32 wt. % to about 43 wt. % bitumen; from about 14 wt. % to about 24 wt. % diluent; from about 7 wt. % to about 12 wt. % solids; and from about 30 wt. % to about 40 wt. % water. Preferably, the diluted feed stream 72 in FIG. 4 has a D/B weight ratio of about 0.43 to about 0.55.

In the embodiment shown in FIG. 4, the chemical additive 16 is introduced into the diluted bitumen feed stream 72 in line 11. The chemical additive 16 may be introduced into the diluted bitumen feed stream 72 in any suitable way, for example with a quill (not shown). For illustration purposes, the chemical additive that is introduced is Emulsotron™ 141 available from Champion Technologies (www.champ-tech-.com) of Houston, Tex. and is injected into the feed stream 72 at about 20 to about 60 ppm. Dosing of the chemical additive can vary with performance objectives. In addition, other chemical additives may have other dosage rates to achieve a similar effect. In the embodiment shown in FIG. 4, the addition of the chemical additive 16 can with the efficacy of concentrating the hydrocarbons in the first overflow stream 74, the second overflow stream 78, the fourth overflow stream 86, and the third overflow stream 82C, and, in turn, can result in the product stream 102C having an improved hydrocarbon concentration compared to a product stream produced without the use of the chemical additive 16.

Advantageously, in the system 10C, the introduction of the chemical additive 16 further enhances the quality of the product streams produced. In this regard, the first overflow stream 74 in FIG. 4 is a bitumen-enriched product stream that typically comprises from about 63 wt. % to about 69 wt. % bitumen; from about 30 wt. % to about 35 wt. % diluent; from about 0.3 wt. % to about 0.55 wt. % solids; and from about 0.9 wt. % to about 1.5 wt. % water. Preferably, the first overflow stream 74 in FIG. 4 has a D/B weight ratio of about 0.43 to about 0.55. The first overflow stream 74 also comprises a hydrocarbon content of about 98.1 wt. % to about 98.7 wt. %. In addition, the third overflow stream 82C typically comprises from about 55 wt. % to about 60 wt. % bitumen; from about 35.0 wt. % to about 40.0 wt. % diluent; from about 0.3 wt. % to about 0.6 wt. % solids; and from about 1.7 wt. % to about 4.1 wt. % water. In addition, the third overflow stream 82C typically has a D/B ratio of about 0.58 to about 0.69 and comprises a hydrocarbon content of about 95 wt. % to about 98 wt. %.

In another aspect of the present invention, the chemical additive 16 may be additionally or alternatively introduced at other addition points within the applicable system (e.g. system 10C). For example, in variations of the embodiment shown in FIG. 4, the chemical additive 16 may be added to one or more of the first overflow stream 74, the first underflow stream 76, the second overflow stream 78, the second underflow stream 80, or the fourth overflow stream 86.

In system 10C, the third overflow stream 82C will preferably be of a quality suitable to be combined with the first overflow stream 74 to form a product stream 102C for use in the upgrader 24. Alternatively, the product stream 102C may be introduced into a further separation stage comprising a storage tank. The fourth underflow stream 88 and the third underflow stream 84C may be combined in line 23A and fed to the solvent recovery unit 36 to recover the solvent 14.

Figure 5:
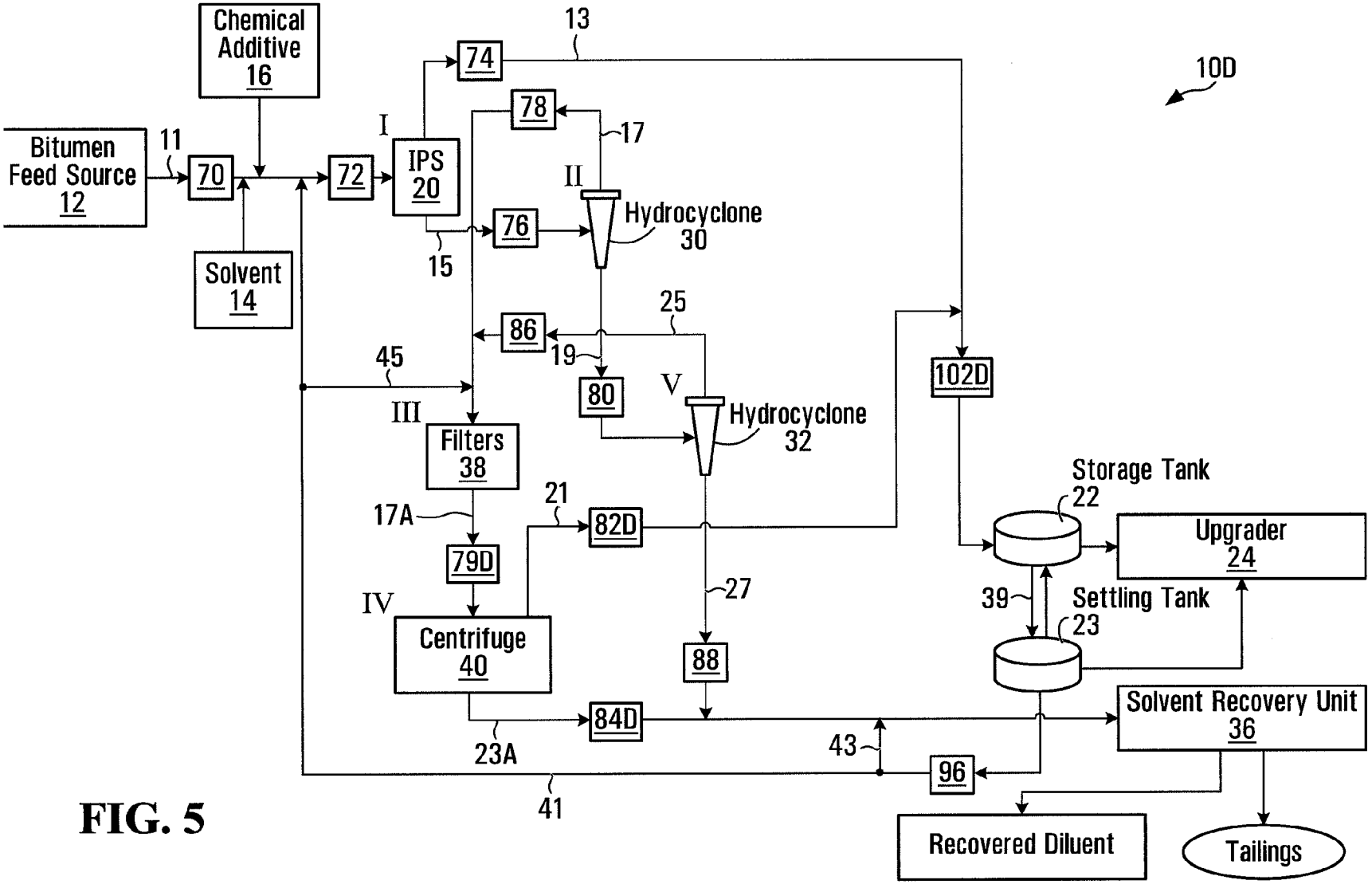
FIG. 5 illustrates a treatment system for concentrating hydrocarbons in a bitumen-rich froth feed according to another embodiment of the present invention.

Referring to FIG. 5, there is shown system 10D, which is another variation of the system 10A shown in FIG. 2. In the embodiment shown in FIG. 5, the system 10D comprises a further separation stage comprising a settling tank 23. The system 10D also may optionally include the addition of the chemical additive 16 in the manner described for system 10C shown in FIG. 4 or, alternatively, another chemical additive to enhance separation within the settling tank 23. In the system 10D, storage tank 22 serves as an initial settling facility in which a residual layer at about or near the bottom of the storage tank 22 is fed as a residual stream through line 39 to the settling tank 23. The residual stream will still contain residual hydrocarbons that are desirable to concentrate. The residual stream collects in the settling tank 23 as a deposit in which hydrocarbon-based components in an aqueous phase are allowed to settle to or near the bottom of the settling tank 23. The layers settling about or near the top of the storage tank 22 and the settling tank 23 are preferably of a quality suitable to be introduced into the upgrader 24, and may be fed to the upgrader 24. In an alternative embodiment of the system 10D, an upper layer in the settling tank 23 may also be re-introduced into the storage tank 22.

The hydrocarbon-based components (residual bitumen and diluent) that are present in the aqueous phase which settles in the settling tank 23 form a slops-type mixture comprising bitumen, diluent (solvent), fine solids and water, which can be routed to solvent recovery unit 36 to recovery a portion of the diluent before the remaining mixture is directed to a tailings pond. However, this approach results in a significant loss of diluent and bitumen. Preferably, at least a portion of the diluent and bitumen would be recovered from the slops-type mixture that is collected, such as in the settling tank 23.

Figure 8:
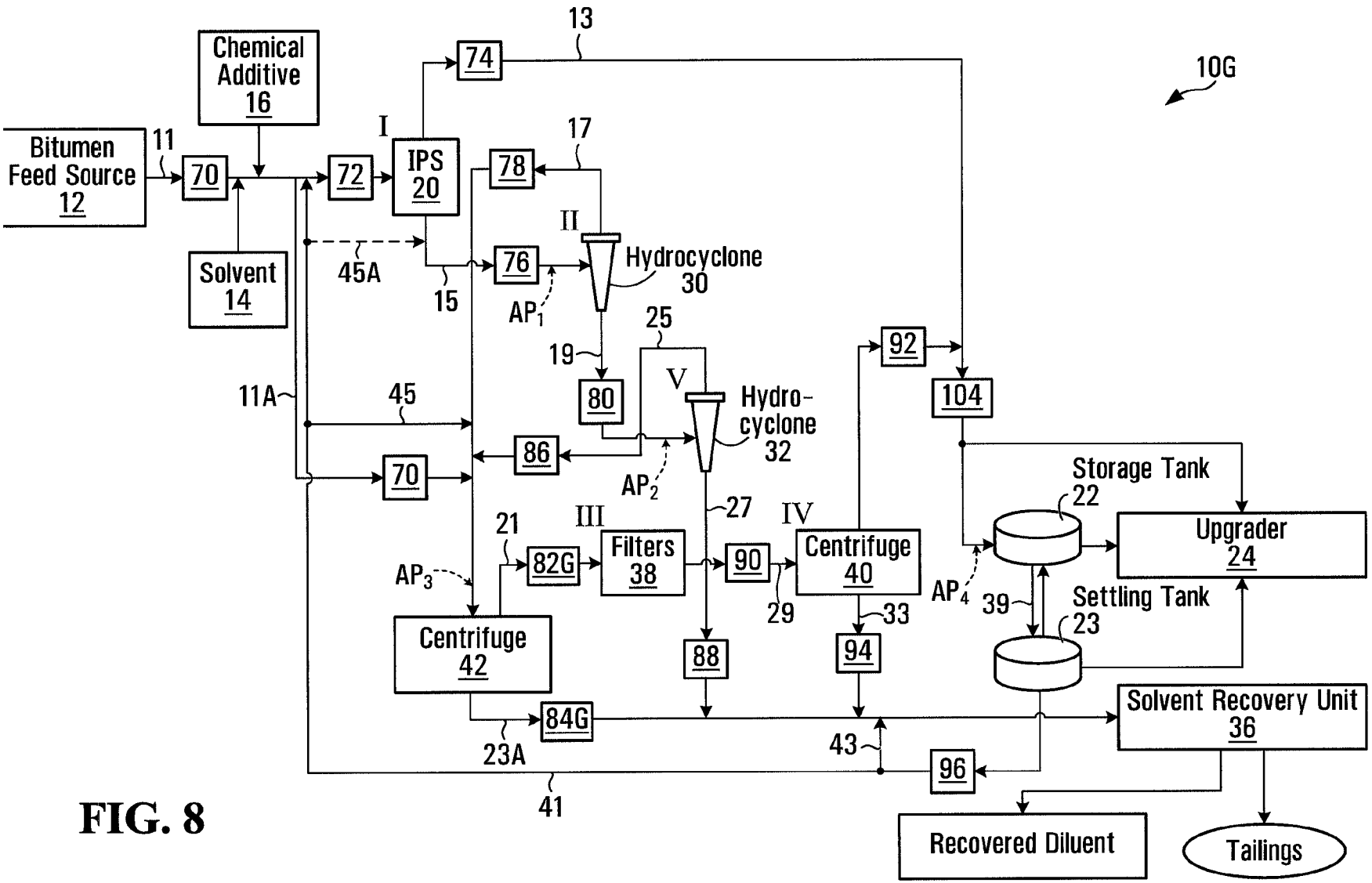
FIG. 8 illustrates a treatment system for concentrating hydrocarbons in a bitumen-rich froth feed according to yet another embodiment of the present invention.
Figure 9:
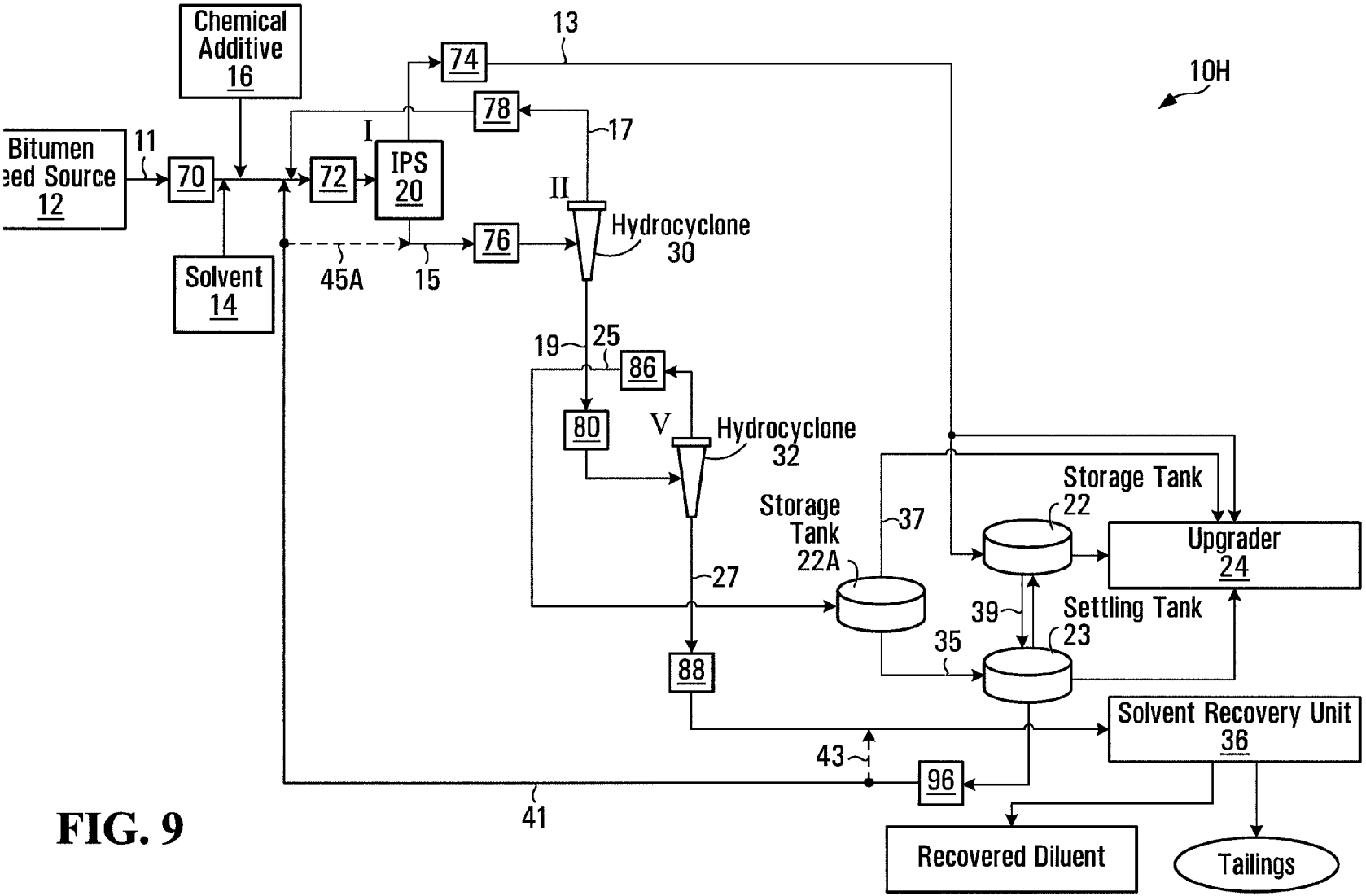
FIG. 9 illustrates a treatment system for concentrating hydrocarbons in a bitumen-rich froth feed according to yet another embodiment of the present invention.

In general, the slops-type mixture may be produced from the processing of a stream within the applicable system (e.g. system 10D) downstream of the centrifuge 40 or one of the hydrocyclones (30, 32). As illustrated in FIG. 5, at least a portion of the slops-type mixture in settling tank 23 is preferably recycled or reintroduced back into system 10D at one or more locations in order to further improve the recovery of bitumen and diluent (solvent). In the variation shown in FIG. 5, a portion of the slops-type mixture is pumped as a residual stream 96 through line 41 and fed to line 11 where it is combined with diluted bitumen feed stream 72 for reintroduction to and further processing through the system 10D preferably beginning with the inclined plate separator 20 to obtain a further hydrocarbon concentration. Optionally or in addition, the residual stream 96 may be fed through line 45 so as to be combined with the second overflow stream 78 in the middle of the system 10D or another location such as with the first underflow 76 (as illustrated in FIGS. 8 and 9). Since the slops-type mixture forms a fairly tight emulsion in settling tank 23, blending this mixture with less emulsified material upstream within system 10D as discussed above contributes to the enhanced recovery of bitumen and diluent from the mixture.

The overflow stream 82D that is produced in system 10D preferably contains a sufficiently high hydrocarbon concentration and sufficiently low water and solids contents such that it is of a quality suitable for combining with the first overflow stream 74 to form a product stream 102D. As with the earlier embodiments described above, the underflow stream 84D is a reject stream, which is fed to the solvent recovery unit 36 to recover residual solvent 14 for reuse.

Figure 6:
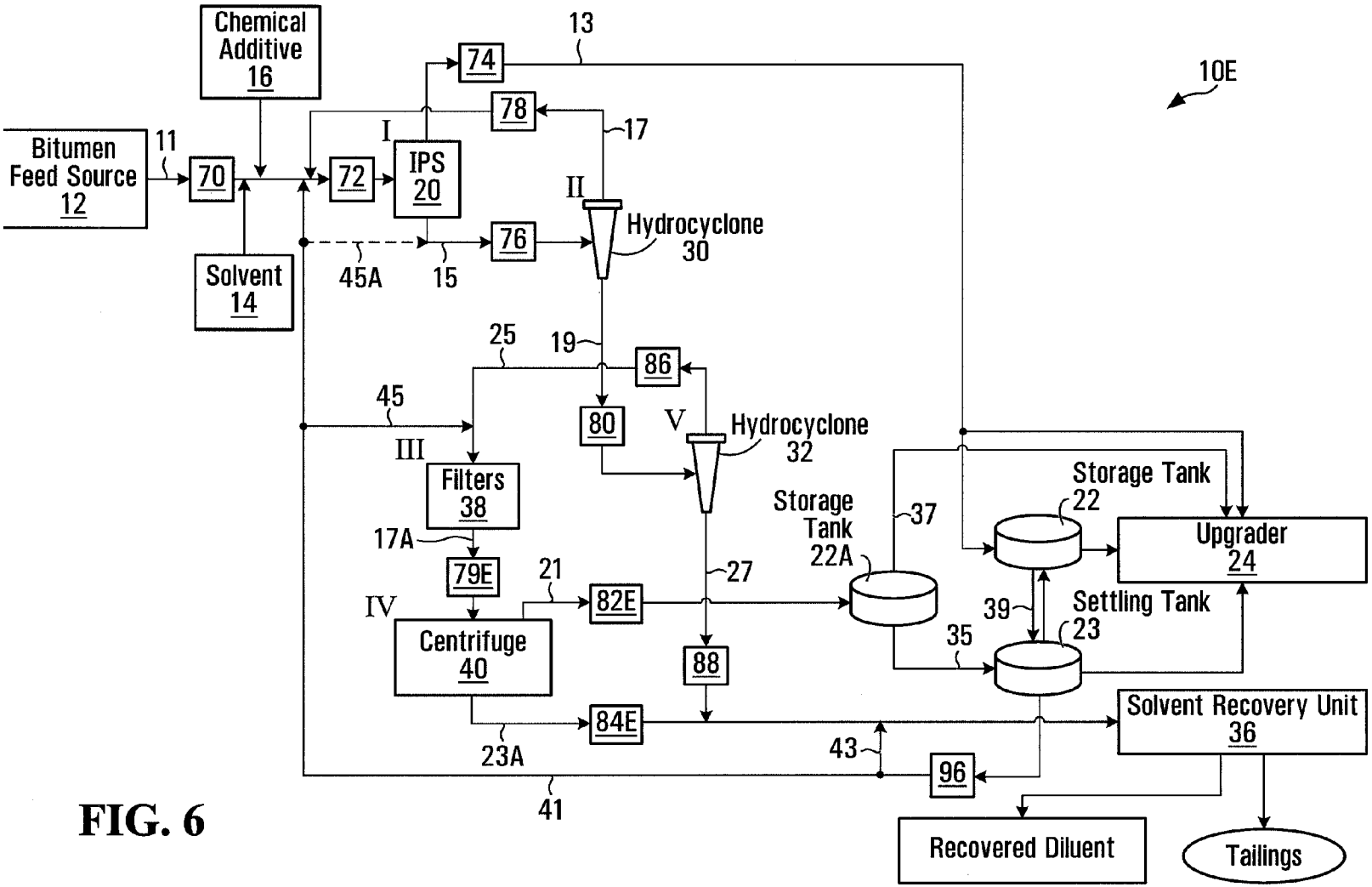
FIG. 6 illustrates a treatment system for concentrating hydrocarbons in a bitumen-rich froth feed according to another embodiment of the present invention.

Referring to FIG. 6, there is shown another embodiment (system 10E), which is a variation of the system 10D shown in FIG. 5. In the embodiment shown in FIG. 6, the second overflow stream 78 formed in separation stage II by the first hydrocyclone 30 is reintroduced through line 17 back into the bitumen feed stream 70 for further processing in the inclined plate separator 20. The reintroduction of the second overflow stream 78 to the bitumen feed stream 70 forms a combined feed stream 72.

The first underflow stream 76 is processed by the hydrocyclone 30 as described in the previous embodiments (e.g. as in system 10A), producing the second overflow stream 78 and the second underflow stream 80. The second underflow stream 80 is fed through line 19 to the second hydrocyclone 32, where it is separated into the fourth overflow stream 86 and the fourth underflow stream 88.

In this embodiment, the fourth overflow stream 86 serves as an intermediate feed stream that is preferably fed through line 25 into filters 38. Filters 38 process the fourth overflow stream 86 to filter out a portion of the solids, resulting in a filtered stream 79E, which is fed through line 21 for processing by the first centrifuge 40 as was described in connection with the first embodiment shown in FIG. 1. The first centrifuge 40 separates the incoming the filtered stream 79E into an overflow stream 82E and an underflow stream 84E.

In system 10E, the overflow stream 82E obtained from the first centrifuge 40 is fed through line 21 to a storage tank 22A. The storage tank 22A is separate from the storage tank 22. The underflow stream 84E is a reject stream, which is fed through line 23A to the solvent recovery unit 36 to recover the residual solvent 14 for reuse. In the system 10E, the two storage tanks 22 and 22A serve as separate initial settling facilities for the first overflow stream 74 and the overflow stream 82E respectively.

The first overflow stream 74 and the overflow stream 82E which accumulate in the storage tanks 22 and 22A respectively will typically each separate into a hydrocarbon-rich layer and a residual layer, with the hydrocarbon-rich layer having a hydrocarbon concentration significantly higher than that of the residual layer. The preferred hydrocarbon-rich layers which typically collect at about or near the top of the storage tanks 22 and 22A may be fed to the upgrader 24 for processing.

Residual layers which collect at about or near the bottom of the storage tanks 22 and 22A are preferably fed as residual streams a further separation stage comprising the settling tank 23. The residual streams entering the settling tank 23 still contain residual hydrocarbons that are desirable to concentrate. The residual streams further separate in the settling tank 23 into a hydrocarbon-rich layer near the top of the tank and an aqueous layer near the bottom of the tank, which will still comprise some residual hydrocarbons. The hydrocarbon-rich layer can be fed from the settling tank 23 to the upgrader 24. Alternatively, the hydrocarbon-rich layer in the settling tank 23 may be fed back into the storage tank 22 to enhance the separation in the settling tank 22. The aqueous layer in the settling tank 23 comprising residual hydrocarbons may be pumped as stream 96 through line 41. In system 10E, the stream 96 is fed to line 11 where it is combined with the diluted bitumen feed stream 70 and with the second overflow stream 78 for re-processing by the system 10E, beginning with the inclined plate separator 20.

Optionally, the stream 96 may also be fed through line 45 so as to be combined with the fourth overflow stream 86 prior to being further processed by filters 38 and the first centrifuge 40. In another variation, the stream 96 may be combined with the first underflow stream 76 prior to being further processed by the first hydrocyclone in separation stage II. The system 10E also may include the addition of a chemical additive in the manner described for system 10C (FIG. 4) or system 10D (FIG. 5).

Figure 7:
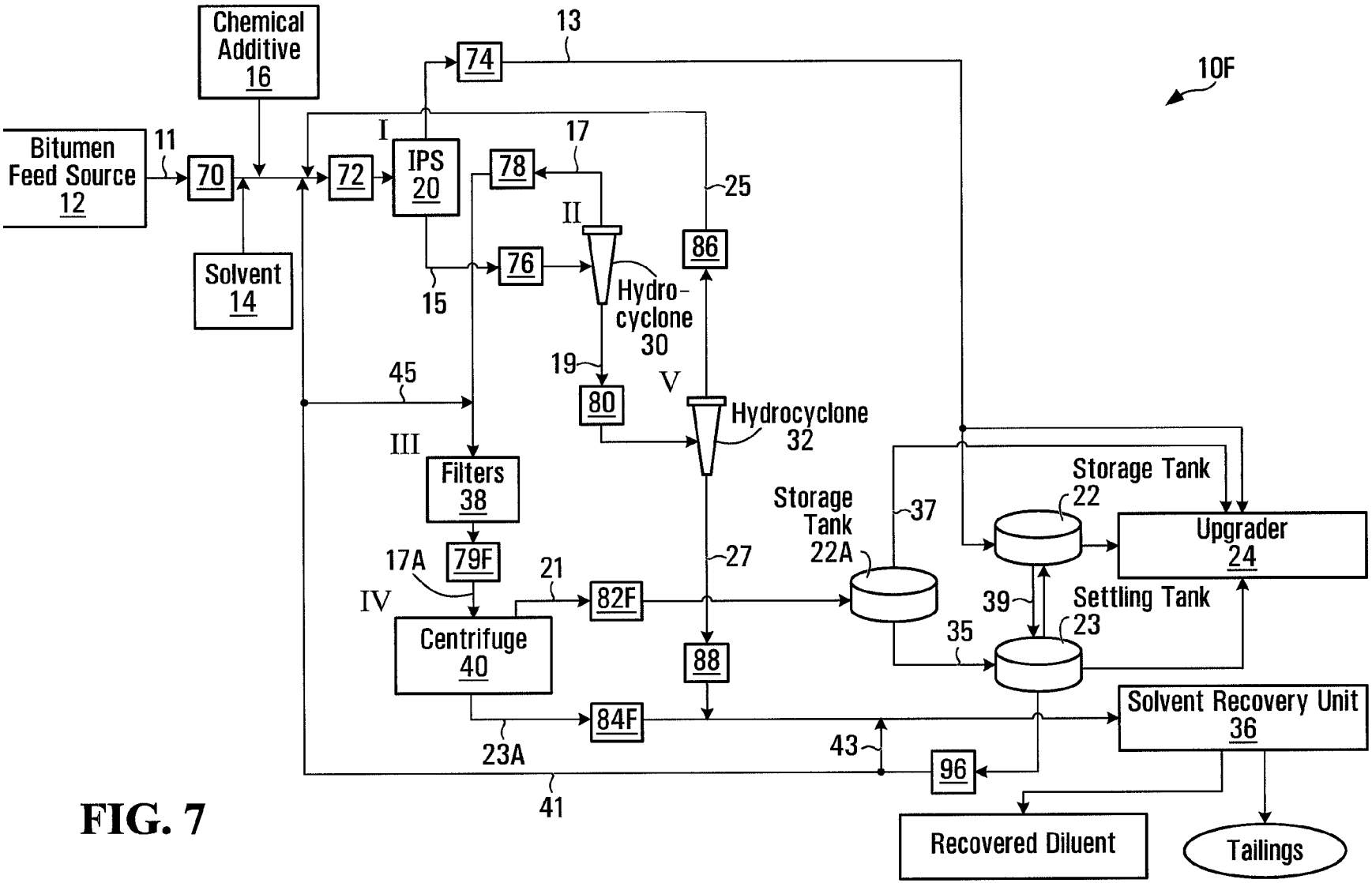
FIG. 7 illustrates a treatment system for concentrating hydrocarbons in a bitumen-rich froth feed according to yet another embodiment of the present invention.

Referring to FIG. 7, there is shown another embodiment (system 10F), which is a variation of the system 10E shown in FIG. 6. In the embodiment shown in FIG. 7, the fourth overflow stream 86 formed in separation stage IV by the second hydrocyclone 32 is introduced through line 25 back into the bitumen feed stream 70. Similarly to what was previously described in connection with the embodiment in FIG. 6, the introduction of the fourth overflow stream 86 into the bitumen feed stream 70 in the system 10F produces a combined feed stream prior to processing of the bitumen feed stream 70 in the inclined plate separator 20.

In this embodiment, the second overflow stream 78 obtained from the first hydrocyclone 30 in separation stage II is fed through line 17 preferably into filters 38, resulting in a filtered stream 79F, which is fed through line 17A to the first centrifuge 40 for processing as described in connection with the first embodiment shown in FIG. 1. The first centrifuge 40 separates the filtered stream 79F into an overflow stream 82F and an underflow stream 84F. The system 10F also may include the addition of a chemical additive in the manner described for system 10C (FIG. 4) or system 10D (FIG. 5).

Referring to FIG. 8, in another embodiment there is shown system 10G which is a variation of the embodiment shown in FIG. 5. In this embodiment, the second overflow stream 78 and the fourth overflow stream 86 are combined into a hydrocarbon-rich stream that is fed to one or more scroll centrifuges 42. The scroll centrifuges 42 are introduced into system 10G to separate coarser particulate matter (e.g. sands, coal, remaining wood pieces and the like) from the incoming hydrocarbon-rich stream. The scroll centrifuges 42 separate the incoming hydrocarbon-rich stream into overflow stream 82G and underflow stream 84G. The overflow stream 82G comprises a higher concentration of hydrocarbons (bitumen and diluent) than that of the underflow stream 84G and also comprises a higher concentration of bitumen than that of the underflow stream 84G. The overflow stream 82G also comprises a lower solids content than the underflow stream 84G.

Optionally, the second overflow stream 78 and the fourth overflow stream 86 may be combined with a portion of the bitumen feed 70, which is fed through line 11A. The addition of a portion of the bitumen feed stream 70 to overflow stream 78 can assist in further improving the concentration of hydrocarbons in the overflow stream 82G.

The overflow stream 82G is fed through line 21 into filters 38 which process the overflow stream 82G to remove a portion of the solids, resulting in a filtered stream 90. Filtered stream 90 is fed through line 21 for processing by centrifuge 40 as was described in connection with the first embodiment shown in FIG. 1. Centrifuge 40 processes the filtered stream 90 to produce overflow stream 92 and underflow stream 94. The product overflow stream 92 serves as a product stream having a quality suitable for use in the upgrader 24.

As discussed earlier with reference to the first embodiment shown in FIG. 1, solvent 14 may optionally be added at multiple addition points to the systems contemplated in the specification. For illustration purposes, FIG. 8 shows optional additional points which include the introduction of additional solvent to: (a) first underflow stream 76 in advance of first hydrocyclone 30 (shown as addition point $AP_1$); (b) second underflow stream 80 in advance of second hydrocyclone 32 (shown as addition point $AP_2$); (c) second overflow stream 78 in advance of centrifuge 42 (shown as addition point $AP_3$); and (d) product stream 104 in advance of storage tank 22 (shown as addition point $AP_4$). The introduction of additional solvent at secondary addition points can help assist in hydrocarbon recovery. In addition, introducing additional solvent at one or more secondary addition points (e.g. at $AP_2$ or $AP_3$) can also assist in removing middlings materials from the applicable system (e.g. system 10G). Preferably, additional solvent is added at a rate that does not increase the overall D/B ratio within the applicable system beyond a predetermined threshold. Preferably, the predetermined threshold for the D/B ratio does not exceed 0.75, and in order to improve the management of solvent losses, more preferably the predetermined threshold for the D/B ratio does not exceed about 0.65.

Referring to FIG. 9, in yet another aspect there is shown system 10H, which is a variation of the system 10D shown in FIG. 5. In the embodiment shown in FIG. 9, filters 38 and centrifuge 40 are removed and the overflow stream 86 produced by hydrocyclone 32 is fed through line 25 to storage tank 22A. Similar to the approach in system 10D, storage tank 22A serves as an initial settling facility in which a residual layer at about or near the bottom of the storage tank 22A is fed as a residual stream through line 35 to settling tank 23. The residual stream forms a slops-type mixture in settling tank 23, which will contain residual bitumen and diluent (solvent) that are desirable to recover. The slops-type mixture in settling tank 23 is preferably reintroduced back into system 10H at one or more locations in order to further improve the recovery of bitumen and diluent. In the variation shown in FIG. 9, a portion of the slops-type mixture is pumped as a residual stream 96 through line 41 and fed to line 11 where it is combined with diluted bitumen feed stream 72 for reintroduction to and further processing through the system 10H beginning with the inclined plate separator 20. Optionally, the residual stream 96 may be fed through line 45A so as to be combined with the first overflow stream 76 upstream of hydrocyclone 30.

Although separation stages I through VI are shown for illustration purposes in FIG. 1 through 9 using a single separation unit in each stage, in another aspect of the present invention multiple separation units can be used in each separation stage depending upon the operational scale of the facility implementing the present invention. For example, in one preferred embodiment of the system shown in FIG. 3, separation stage I comprises a plurality of inclined plate separators cooperating in parallel to process bitumen feed stream 70, separation stage II comprises a plurality of hydrocyclones cooperating in parallel to process the first underflow stream 76, separation stage IV comprises a plurality of disk centrifuges cooperating in parallel to process the second overflow stream 78 and the fourth overflow stream 86, and separation stage V comprises a plurality of hydrocyclones cooperating in parallel to process the fourth underflow stream 80.

Although specific embodiments of the invention have been described and illustrated, such embodiments should not to be construed in a limiting sense. Various modifications of form, arrangement of components, steps, details and order of operations of the embodiments illustrated, as well as other embodiments of the invention, will be apparent to persons skilled in the art upon reference to this description. It is therefore contemplated that the appended claims will cover such modifications and embodiments as fall within the true scope of the invention. In the specification including the claims, numeric ranges are inclusive of the numbers defining the range. Citation of references herein shall not be construed as an admission that such references are prior art to the present invention.

What is claimed is:

1. A process for concentrating hydrocarbons in a bitumen feed comprising bitumen, water and solids, the process comprising separating, in an inclined plate separator, the bitumen feed into a first overflow stream and a first underflow stream, the first overflow stream having a first bitumen concentration greater than that of the first underflow stream; separating, in a first cyclone, the first underflow stream into a second overflow stream and a second underflow stream; and separating, in a first centrifuge, the second overflow stream into a third overflow stream and a third underflow stream, the third overflow stream having a third bitumen concentration that is greater than that of the third underflow stream; wherein the first overflow stream and the third overflow stream each are suitable for use by an upgrader.

2. The process according to claim 1 further comprising separating, in a second cyclone, the second underflow stream into a fourth overflow stream and a fourth underflow stream, the fourth overflow stream having a fourth bitumen concentration greater than that of the fourth underflow stream; and upstream of the first centrifuge, combining the fourth overflow stream with the second overflow stream to form a partially processed overflow mixture for further processing in the first centrifuge.

3. The process according to claim 2 further comprising separating, in a second centrifuge, the third overflow stream into a fifth overflow stream and a fifth underflow stream, the fifth overflow stream having a fifth bitumen concentration greater than that of the fifth underflow stream.

4. The process according to claim 1 further comprising, upstream of the first centrifuge, filtering, in a first filter, the second overflow stream.

5. The process according to claim 2 further comprising, upstream of the first centrifuge, filtering, in a first filter, the partially processed overflow mixture.

6. The process according to claim 1 further comprising introducing a solvent comprising a liquid hydrocarbon to the bitumen feed to dilute the bitumen feed.

7. The process according to claim 6 wherein the liquid hydrocarbon comprises naphtha.

8. The process according to claim 6 further comprising introducing additional solvent to at least one of the first underflow stream, the second overflow stream and the second underflow stream.

9. The process according to claim 1 wherein the third overflow stream has less than about 1.2 wt. % solids.

10. The process according to claim 1 wherein the third overflow stream has less than about 1.0 wt. % solids.

11. The process according to claim 1 wherein the third overflow stream has about 0.4 wt. % to about 0.8 wt. % solids.

12. The process according to claim 1 wherein the third overflow stream has about 0.3 wt. % to about 0.6 wt. % solids.

13. The process according to claim 1 wherein the third overflow stream has less than about 0.5 wt. % solids.

14. The process according to claim 1 wherein the first overflow stream has less than about 1.2 wt. % solids.

15. The process according to claim 1 wherein the first overflow stream has less than about 1.0 wt. % solids.

16. The process according to claim 1 wherein the first bitumen concentration is at least about 98 wt. % of the first overflow stream.

17. The process according to claim 1 wherein the third bitumen concentration is at least about 95 wt. % of the third overflow stream.

18. The process according to claim 1 wherein the third bitumen concentration is at least about 98 wt. % of the third overflow stream.

19. The process according to claim 1 wherein the first overflow stream has about 0.9 wt. % to about 1.5 wt. % water.

20. The process according to claim 1 further comprising collecting a slops-type mixture comprising bitumen, solvent, fine solids and water in a settling tank, the slops-type mixture produced from the processing of a stream downstream of the centrifuge or the first cyclone; and combining at least a portion of the slops-type mixture with at least one of the bitumen feed stream, the first underflow stream and the second overflow stream.

21. The process according to claim 1 further comprising treating the bitumen feed with a chemical additive.

22. The process according to claim 21 further comprising introducing additional chemical additive to at least one of the first overflow stream, the first underflow stream, the second overflow stream and the second underflow stream.

23. A system for concentrating hydrocarbons in a bitumen feed comprising bitumen, water and solids, the system comprising means for separating, in an inclined plate separator, the bitumen feed into a first overflow stream and a first underflow stream, the first overflow stream having a first bitumen concentration greater than that of the first underflow stream; means for separating, in a first cyclone, the first underflow stream into a second overflow stream and a second underflow stream; and means for separating, in a first centrifuge, the second overflow stream into a third overflow stream and a third underflow stream, the third overflow stream having a third bitumen concentration that is greater than that of the third underflow stream.

24. The system according to claim 23 further comprising means for separating, in a second cyclone, the second underflow stream into a fourth overflow stream and a fourth underflow stream, the fourth overflow stream having a fourth bitumen concentration greater than that of the fourth underflow stream; and means for combining the fourth overflow stream with the second overflow stream, upstream of the first centrifuge, to form a partially processed overflow mixture for further processing in the first centrifuge.

25. The system according to claim 24 further comprising means for separating, in a second centrifuge, the third overflow stream into a fifth overflow stream and a fifth underflow stream, the fifth overflow stream having a fifth bitumen concentration greater than that of the fifth underflow stream.

26. The system according to claim 23 further comprising means for filtering the second overflow stream upstream of the first centrifuge.

27. The system according to claim 25 further comprising means for filtering the partially processed overflow mixture upstream of the first centrifuge.

28. The system according to claim 23 further comprising means for introducing a solvent comprising a liquid hydrocarbon to the bitumen feed to dilute the bitumen feed.

29. The system according to claim 28 wherein the liquid hydrocarbon comprises naphtha.

30. The system according to claim 28 further comprising means for introducing additional solvent to at least one of the first underflow stream, the second overflow stream and the second underflow stream.

31. The system according to claim 23 wherein the third overflow stream has less than about 1.2 wt. % solids.

32. The system according to claim 23 wherein the third overflow stream has less than about 1.0 wt. % solids.

33. The system according to claim 23 wherein the third overflow stream has about 0.4 wt. % to about 0.8 wt. % solids.

34. The system according to claim 23 wherein the third overflow stream has about 0.3 wt. % to about 0.6 wt. % solids.

35. The system according to claim 23 wherein the third overflow stream has less than about 0.5 wt. % solids.

36. The system according to claim 23 wherein the first overflow stream has less than about 1.2 wt. % solids.

37. The system according to claim 23 wherein the first overflow stream has less than about 1.0 wt. % solids.

38. The system according to claim 23 wherein the first bitumen concentration is at least about 98 wt. % of the first overflow stream.

39. The system according to claim 23 wherein the third bitumen concentration is at least about 95 wt. % of the third overflow stream.

40. The system according to claim 23 wherein the third bitumen concentration is at least about 98 wt. % of the third overflow stream.

41. The system according to claim 23 wherein the first overflow stream has about 0.9 wt. % to about 1.5 wt. % water.

42. The system according to claim 23 further comprising means for collecting a slops-type mixture comprising bitumen, solvent, fine solids and water in a settling tank, the slops-type mixture produced from the processing of a stream downstream of the centrifuge or the first cyclone; and means for combining at least a portion of the slops-type mixture with at least one of the bitumen feed stream, the first underflow stream and the second overflow stream.

43. The system according to claim 23 further comprising means for treating the bitumen feed with a chemical additive.

44. The system according to claim 43 further comprising means for introducing additional chemical additive to at least one of the first overflow stream, the first underflow stream, the second overflow stream and the second underflow stream.

45. A system for concentrating hydrocarbons in a bitumen feed comprising bitumen, water and solids, the system comprising an inclined plate separator operably configured to separate the bitumen feed into a first overflow stream and a first underflow stream, the first overflow stream having a first bitumen concentration greater than that of the first underflow stream; a first cyclone operably configured to separate the first underflow stream into a second overflow stream and a second underflow stream, the second overflow stream having a second bitumen concentration greater than that of the second underflow stream; and a first centrifuge operably configured to separate the second overflow stream into a third overflow stream and a third underflow stream, wherein the first overflow stream and the third overflow stream each comprise about or less than about 1.0 wt. % solids.

46. The system according to claim 45 further comprising a second cyclone operably configured to separate the second underflow stream into a fourth overflow stream and a fourth underflow stream, the fourth overflow stream having a fourth bitumen concentration greater than that of the fourth underflow stream; and a conduit for combining the fourth overflow stream with the second overflow stream, upstream of the first centrifuge, to form a partially processed overflow mixture for further processing in the first centrifuge.

47. The system according to claim 46 further comprising a second centrifuge for separating the third overflow stream into a fifth overflow stream and a fifth underflow stream, the fifth overflow stream having a fifth bitumen concentration greater than that of the fifth underflow stream.

48. The system according to claim 44 further comprising a filter for filtering the second overflow stream upstream of the first centrifuge.

49. The system according to claim 47 further comprising a filter for filtering the partially processed overflow mixture upstream of the first centrifuge.

50. The process according to claim 4 further comprising: introducing a solvent comprising a liquid hydrocarbon to the bitumen feed to dilute the bitumen feed, and introducing additional solvent to at least one of the first underflow stream, the second overflow stream and the second underflow stream; treating the bitumen feed with a chemical additive, and introducing additional chemical additive to at least one of the first overflow stream, the first underflow stream, the second overflow stream and the second underflow stream; and feeding the second underflow stream and the third underflow stream to a solvent recovery unit, and recovering a residual solvent for reuse;

wherein the second overflow stream has a second bitumen concentration greater than that of the second underflow stream; wherein the first overflow stream comprises from about 30 wt. % to about 40 wt. % diluent, from about 0.5 wt. % to about 2.0 wt. % solids, from about 1.0 wt. % to about 6.0 wt. % water, and a hydrocarbon content of about 93 wt. % to about 98 wt. %; wherein the first overflow stream has a diluent to bitumen weight ratio of about 0.45 to about 0.62; wherein the third overflow stream comprises from about 54 wt. % to about 60 wt. % bitumen, from about 33 wt. % to about 39 wt. % diluent, from about 0.4 wt. % to about 0.8 wt. % solids, from about 5.0 wt. % to about 12.0 wt. % water, and a hydrocarbon content of about 88 wt. % to about 95.5 wt. %; and wherein the third overflow stream has a diluent to bitumen weight ratio of about 0.6 to about 0.7.

51. The process according to claim 5 further comprising: introducing a solvent comprising a liquid hydrocarbon to the bitumen feed to dilute the bitumen feed, and introducing additional solvent to at least one of the first underflow stream, the second overflow stream, the second underflow stream and the fourth overflow stream; and treating the bitumen feed with a chemical additive, and introducing additional chemical additive to at least one of the first overflow stream, the first underflow stream, the second overflow stream, the second underflow stream and the fourth overflow stream;

wherein the second overflow stream has a second bitumen concentration greater than that of the second underflow stream; wherein the first overflow stream comprises from about 0.3 wt. % to about 0.55 wt. % solids, from about 0.9 wt. % to about 1.5 wt. % water, and a hydrocarbon content of about 98.1 wt. % to about 98.7 wt. %; wherein the third overflow stream comprises from about 0.3 wt. % to about 0.6 wt. % solids, from about 1.7 wt. % to about 4.1 wt. % water, and a hydrocarbon content of about 95 wt. % to about 98 wt. %; and wherein the first cyclone has a gravitational separation force that is at least significantly higher than that of the inclined plate separator; and the first centrifuge has a gravitational separation force that is substantially higher than that of the second cyclone.

52. The process according to claim 1 further comprising: separating, in a second cyclone, the second underflow stream into a fourth overflow stream and a fourth underflow stream, the fourth overflow stream having a fourth bitumen concentration greater than that of the fourth underflow stream; upstream of the inclined plate separator, combining the fourth overflow stream with the bitumen feed stream to form a combined feed stream for processing in the inclined plate separator; upstream of the first centrifuge, filtering, in a first filter, the second overflow stream; introducing a solvent comprising a liquid hydrocarbon to the bitumen feed to dilute the bitumen feed, and introducing additional solvent to at least one of the first underflow stream, the second overflow stream, the second underflow stream and the fourth overflow stream;

and treating the bitumen feed with a chemical additive, and introducing additional chemical additive to at least one of the first overflow stream, the first underflow stream, the second overflow stream, the second underflow stream and the fourth overflow stream;

wherein the second overflow stream has a second bitumen concentration greater than that of the second underflow stream; wherein the first overflow stream comprises from about 0.3 wt. % to about 0.55 wt. % solids, from about 0.9 wt. % to about 1.5 wt. % water, and a hydrocarbon content of about 98.1 wt. % to about 98.7 wt. %; wherein the third overflow stream comprises from about 0.3 wt. % to about 0.6 wt. % solids, from about 1.7 wt. % to about 4.1 wt. % water, and a hydrocarbon content of about 95 wt. % to about 98 wt. %; and wherein the first cyclone has a gravitational separation force that is at least significantly higher than that of the inclined plate separator; and the first centrifuge has a gravitational separation force that is substantially higher than that of the second cyclone.

53. The process according to claim 1 further comprising: separating, in a second cyclone, the second underflow stream into a fourth overflow stream and a fourth underflow stream, the fourth overflow stream having a fourth bitumen concentration greater than that of the fourth underflow stream; separating, in a third cyclone, the fourth underflow stream into a sixth overflow stream and a sixth underflow stream, the sixth overflow stream having a sixth bitumen concentration greater than that of the sixth underflow stream; upstream of the first cyclone, combining the fourth overflow stream with the first underflow stream to form a first partially processed mixture for further processing in the first cyclone; upstream of the second cyclone, combining the sixth overflow stream with the second underflow stream to form a second partially processed mixture for further processing in the second cyclone; upstream of the first centrifuge, filtering, in a first filter, the second overflow stream; introducing a solvent comprising a liquid hydrocarbon to the bitumen feed to dilute the bitumen feed, and introducing additional solvent to at least one of the first underflow stream, the second overflow stream, the second underflow stream and the fourth overflow stream; treating the bitumen feed with a chemical additive, and introducing additional chemical additive to at least one of the first overflow stream, the first underflow stream, the second overflow stream, the second underflow stream and the fourth overflow stream; and feeding the third underflow stream and the sixth underflow stream to a solvent recovery unit, and recovering a residual solvent for reuse;

wherein the second overflow stream has a second bitumen concentration greater than that of the second underflow stream; wherein the first overflow stream comprises from about 63 wt. % to about 69 wt. % bitumen, from about 30 wt. % to about 35 wt. % diluent, from about 0.3 wt. % to about 0.55 wt. % solids, from about 0.9 wt. % to about 1.5 wt. % water, and a hydrocarbon content of about 98.1 wt. % to about 98.7 wt. %; wherein the first overflow stream has a diluent to bitumen weight ratio of about 0.43 to about 0.55; wherein the third overflow stream comprises from about 55 wt. % to about 60 wt. % bitumen, from about 35.0 wt. % to about 40.0 wt. % diluent, from about 0.3 wt. % to about 0.6 wt. % solids, from about 1.7 wt. % to about 4.1 wt. % water, and a hydrocarbon content of about 95 wt. % to about 98 wt. %; wherein the third overflow stream has a diluent to bitumen ratio of about 0.58 to about 0.69; and wherein the third cyclone has a gravitational separation force that is at least significantly higher than that of the second cyclone; the first cyclone has a gravitational separation force that is at least significantly higher than that of the inclined plate separator; and the first centrifuge has a gravitational separation force that is substantially higher than that of the third cyclone.

54. The system according to claim 26 further comprising: means for introducing a solvent comprising a liquid hydrocarbon to the bitumen feed to dilute the bitumen feed, and means for introducing additional solvent to at least one of the first underflow stream, the second overflow stream and the second underflow stream; means for treating the bitumen feed with a chemical additive, and means for introducing additional chemical additive to at least one of the first overflow stream, the first underflow stream, the second overflow stream and the second underflow stream; and means for feeding the second underflow stream and the third underflow stream to a solvent recovery unit, and means for recovering a residual solvent for reuse;

wherein the second overflow stream has a second bitumen concentration greater than that of the second underflow stream; wherein the first overflow stream comprises from about 30 wt. % to about 40 wt. % diluent, from about 0.5 wt. % to about 2.0 wt. % solids, from about 1.0 wt. % to about 6.0 wt. % water, and a hydrocarbon content of about 93 wt. % to about 98 wt. %; wherein the first overflow stream has a diluent to bitumen weight ratio of about 0.45 to about 0.62; wherein the third overflow stream comprises from about 54 wt. % to about 60 wt. % bitumen, from about 33 wt. % to about 39 wt. % diluent, from about 0.4 wt. % to about 0.8 wt. % solids, from about 5.0 wt. % to about 12.0 wt. % water, and a hydrocarbon content of about 88 wt. % to about 95.5 wt. %; and wherein the third overflow stream has a diluent to bitumen weight ratio of about 0.6 to about 0.7.

55. The system according to claim 27 further comprising: means for introducing a solvent comprising a liquid hydrocarbon to the bitumen feed to dilute the bitumen feed, and means for introducing additional solvent to at least one of the first underflow stream, the second overflow stream, the second underflow stream and the fourth overflow stream; and means for treating the bitumen feed with a chemical additive, and means for introducing additional chemical additive to at least one of the first overflow stream, the first underflow stream, the second overflow stream, the second underflow stream and the fourth overflow stream;

wherein the second overflow stream has a second bitumen concentration greater than that of the second underflow stream; wherein the first overflow stream comprises from about 0.3 wt. % to about 0.55 wt. % solids, from about 0.9 wt. % to about 1.5 wt. % water, and a hydrocarbon content of about 98.1 wt. % to about 98.7 wt. %; wherein the third overflow stream comprises from about 0.3 wt. % to about 0.6 wt. % solids, from about 1.7 wt. % to about 4.1 wt. % water, and a hydrocarbon content of about 95 wt. % to about 98 wt. %; and wherein the first cyclone has a gravitational separation force that is at least significantly higher than that of the inclined plate separator; and the first centrifuge has a gravitational separation force that is substantially higher than that of the second cyclone.

56. The system according to claim 23 further comprising: means for separating, in a second cyclone, the second underflow stream into a fourth overflow stream and a fourth underflow stream, the fourth overflow stream having a fourth bitumen concentration greater than that of the fourth underflow stream; means for combining the fourth overflow stream with the bitumen feed stream, upstream of the inclined plate separator, to form a combined feed stream for processing in the inclined plate separator; means for filtering the second overflow stream upstream of the first centrifuge; means for introducing a solvent comprising a liquid hydrocarbon to the bitumen feed to dilute the bitumen feed, and means for introducing additional solvent to at least one of the first underflow stream, the second overflow stream, the second underflow stream and the fourth overflow stream; and means for treating the bitumen feed with a chemical additive, and means for introducing additional chemical additive to at least one of the first overflow stream, the first underflow stream, the second overflow stream, the second underflow stream and the fourth overflow stream;

wherein the second overflow stream has a second bitumen concentration greater than that of the second underflow stream; wherein the first overflow stream comprises from about 0.3 wt. % to about 0.55 wt. % solids, from about 0.9 wt. % to about 1.5 wt. % water, and a hydrocarbon content of about 98.1 wt. % to about 98.7 wt. %; wherein the third overflow stream comprises from about 0.3 wt. % to about 0.6 wt. % solids, from about 1.7 wt. % to about 4.1 wt. % water, and a hydrocarbon content of about 95 wt. % to about 98 wt. %; and wherein the first cyclone has a gravitational separation force that is at least significantly higher than that of the inclined plate separator; and the first centrifuge has a gravitational separation force that is substantially higher than that of the second cyclone.

57. The system according to claim 23 further comprising: means for separating, in a second cyclone, the second underflow stream into a fourth overflow stream and a fourth underflow stream, the fourth overflow stream having a fourth bitumen concentration greater than that of the fourth underflow stream; means for separating, in a third cyclone, the fourth underflow stream into a sixth overflow stream and a sixth underflow stream, the sixth overflow stream having a sixth bitumen concentration greater than that of the sixth underflow stream; means for combining the fourth overflow stream with the first underflow stream, upstream of the first cyclone, to form a first partially processed mixture for further processing in the first cyclone; means for combining the sixth overflow stream with the second underflow stream, upstream of the second cyclone, to form a second partially processed mixture for further processing in the second cyclone; means for filtering the second overflow stream upstream of the first centrifuge; means for introducing a solvent comprising a liquid hydrocarbon to the bitumen feed to dilute the bitumen feed, and means for introducing additional solvent to at least one of the first underflow stream, the second overflow stream, the second underflow stream and the fourth overflow stream; means for treating the bitumen feed with a chemical additive, and means for introducing additional chemical additive to at least one of the first overflow stream, the first underflow stream, the second overflow stream, the second underflow stream and the fourth overflow stream; and means for feeding the third underflow stream and the sixth underflow stream to a solvent recovery unit, and means for recovering a residual solvent for reuse;

wherein the second overflow stream has a second bitumen concentration greater than that of the second underflow stream; wherein the first overflow stream comprises from about 63 wt. % to about 69 wt. % bitumen, from about 30 wt. % to about 35 wt. % diluent, from about 0.3 wt. % to about 0.55 wt. % solids, from about 0.9 wt. % to about 1.5 wt. % water, and a hydrocarbon content of about 98.1 wt. % to about 98.7 wt. %; wherein the first overflow stream has a diluent to bitumen weight ratio of about 0.43 to about 0.55; wherein the third overflow stream comprises from about 55 wt. % to about 60 wt. % bitumen, from about 35.0 wt. % to about 40.0 wt. % diluent, from about 0.3 wt. % to about 0.6 wt. % solids, from about 1.7 wt. % to about 4.1 wt. % water, and a hydrocarbon content of about 95 wt. % to about 98 wt. %; wherein the third overflow stream has a diluent to bitumen ratio of about 0.58 to about 0.69; and wherein the third cyclone has a gravitational separation force that is at least significantly higher than that of the second cyclone; the first cyclone has a gravitational separation force that is at least significantly higher than that of the inclined plate separator; and the first centrifuge has a gravitational separation force that is substantially higher than that of the third cyclone.

* * * * *